US010040214B2

(12) United States Patent
Baratta

(10) Patent No.: US 10,040,214 B2
(45) Date of Patent: Aug. 7, 2018

(54) CHAIN BAR APPARATUS AND METHODS AND TOOL COMBINATIONS AND METHODS OF MAKING AND USING MOVING TOOL COMBINATIONS

(75) Inventor: Anthony Baratta, Oak Park, CA (US)

(73) Assignee: BARON INVESTMENTS LLC, Oxnard, CA (US)

( * ) Notice: Subject to any disclaimer, the term of this patent is extended or adjusted under 35 U.S.C. 154(b) by 391 days.

(21) Appl. No.: 13/641,617

(22) PCT Filed: Jul. 21, 2010

(86) PCT No.: PCT/US2010/042822
§ 371 (c)(1),
(2), (4) Date: Oct. 16, 2012

(87) PCT Pub. No.: WO2011/129843
PCT Pub. Date: Oct. 20, 2011

(65) Prior Publication Data

US 2013/0031793 A1 Feb. 7, 2013

Related U.S. Application Data

(60) Provisional application No. 61/325,267, filed on Apr. 16, 2010.

(51) Int. Cl.
*B27B 17/02* (2006.01)
*B27B 17/12* (2006.01)

(52) U.S. Cl.
CPC ..... *B27B 17/025* (2013.01); *B27B 17/12* (2013.01); *Y10T 29/49826* (2015.01); *Y10T 428/24777* (2015.01)

(58) Field of Classification Search
CPC ..... B27B 17/00–17/0033; B27B 17/02–17/14; B23D 57/023
USPC ..... 30/381–387; D8/70; 76/112
See application file for complete search history.

(56) References Cited

U.S. PATENT DOCUMENTS

| | | | | | |
|---|---|---|---|---|---|
| 2,034,058 | A | * | 3/1936 | Sacrey | 30/381 |
| 2,642,901 | A | * | 6/1953 | Hayden | 30/371 |
| 2,698,034 | A | * | 12/1954 | Jakku | 30/371 |
| 2,925,105 | A | * | 2/1960 | Hayden | 30/383 |
| 3,545,505 | A | * | 12/1970 | DeWesse et al. | 83/821 |
| 3,808,684 | A | * | 5/1974 | Ludwig | 30/382 |

(Continued)

FOREIGN PATENT DOCUMENTS

| | | | | | |
|---|---|---|---|---|---|
| CA | 2769321 | A1 | * | 2/2011 | B27B 17/14 |
| CA | 2769635 | A1 | * | 2/2011 | B27B 17/02 |

(Continued)

OTHER PUBLICATIONS

Lee, Young; International Search Report, dated Sep. 17, 2010, 2 pages, ISA/US.

(Continued)

*Primary Examiner* — Jason Daniel Prone
(74) *Attorney, Agent, or Firm* — Henricks, Slavin & Holmes LLP

(57) ABSTRACT

Chain bar apparatus and methods are disclosed that may be formed from plastic, metal or other materials. Laser cutting of a chain bar core can provide improved structural characteristics, for example when adhesive is used to assemble the chain bar. Flow diversion elements can be used to optimize flow throughout the chain bar.

34 Claims, 12 Drawing Sheets

(56) References Cited

U.S. PATENT DOCUMENTS

| | | | | | |
|---|---|---|---|---|---|
| 3,815,229 | A * | 6/1974 | Granberg | 30/124 |
| 3,949,475 | A * | 4/1976 | Tokarz | 30/387 |
| 4,142,292 | A * | 3/1979 | Ulrich | 30/371 |
| 4,334,358 | A * | 6/1982 | Reynolds | 30/387 |
| 4,361,960 | A * | 12/1982 | Halverson | 30/385 |
| 4,393,590 | A * | 7/1983 | Pantzar | 30/387 |
| 4,486,953 | A * | 12/1984 | Halverson | 30/385 |
| 4,654,972 | A * | 4/1987 | Sellmaier et al. | 30/385 |
| 4,920,947 | A * | 5/1990 | Scott et al. | 30/381 |
| 5,025,561 | A * | 6/1991 | Sugihara et al. | 30/387 |
| 5,035,058 | A * | 7/1991 | Date et al. | 30/387 |
| 5,050,303 | A | 9/1991 | Sinclair et al. | |
| 5,067,243 | A * | 11/1991 | O'Neel | 30/387 |
| 5,078,119 | A * | 1/1992 | Holmes et al. | 125/13.01 |
| 5,092,044 | A * | 3/1992 | Edgerton et al. | 30/381 |
| 5,123,168 | A * | 6/1992 | Lyons | 30/382 |
| 5,216,814 | A * | 6/1993 | McGregor | 30/387 |
| 5,271,157 | A * | 12/1993 | Wieninger et al. | 30/387 |
| 5,349,754 | A | 9/1994 | Wuensch | |
| 5,560,111 | A * | 10/1996 | Dofredo | 30/382 |
| 5,564,192 | A * | 10/1996 | Wilhelm et al. | 30/387 |
| 5,669,145 | A * | 9/1997 | Skripsky | 30/382 |
| 5,671,537 | A * | 9/1997 | Dofredo | 29/740 |
| 5,797,187 | A * | 8/1998 | Leini et al. | 30/387 |
| 5,842,279 | A * | 12/1998 | Andress et al. | 30/387 |
| 5,878,499 | A * | 3/1999 | King et al. | 30/382 |
| 6,054,671 | A * | 4/2000 | Shelton et al. | 76/112 |
| 6,061,915 | A * | 5/2000 | Seigneur et al. | 30/386 |
| 6,138,339 | A * | 10/2000 | Escher et al. | 30/387 |
| 6,397,475 | B1 * | 6/2002 | Pettersson et al. | 30/383 |
| 6,412,464 | B1 | 7/2002 | Schneider et al. | |
| 6,427,342 | B1 * | 8/2002 | Breitbarth et al. | 30/387 |
| 6,536,119 | B1 * | 3/2003 | Carr | 30/383 |
| 6,698,101 | B2 * | 3/2004 | Chen | 30/387 |
| 6,964,101 | B2 * | 11/2005 | Graves et al. | 30/387 |
| 7,631,430 | B2 * | 12/2009 | Chang | 30/381 |
| 7,818,886 | B1 * | 10/2010 | Grindstaff et al. | 30/383 |
| 8,156,654 | B2 * | 4/2012 | Reed et al. | 30/382 |
| 8,225,515 | B2 * | 7/2012 | Ruth | 30/387 |
| 8,322,385 | B2 * | 12/2012 | Kauppila | 30/381 |
| 8,661,695 | B2 * | 3/2014 | Hermansen | B27B 17/025 30/383 |
| 8,707,943 | B2 * | 4/2014 | Berglund et al. | 30/383 |
| 9,272,438 | B2 * | 3/2016 | Amend | B27B 17/025 30/383 |
| 2008/0244915 | A1 * | 10/2008 | Ruth | 30/387 |
| 2010/0037472 | A1 * | 2/2010 | Lucas et al. | 30/383 |
| 2011/0192039 | A1 * | 8/2011 | Fuchs et al. | 30/383 |
| 2012/0176806 | A1 * | 7/2012 | Baratta | 30/387 |
| 2014/0250701 | A1 * | 9/2014 | Amend et al. | 30/383 |
| 2015/0047491 | A1 * | 2/2015 | Schamberg | B27B 17/02 30/383 |
| 2015/0052762 | A1 * | 2/2015 | Fuchs | B27B 17/025 30/387 |
| 2016/0339598 | A1 * | 11/2016 | Beerens | B27B 17/025 30/381 |
| 2018/0015632 | A1 * | 1/2018 | Johansson | B27B 17/12 83/830 |
| 2018/0036901 | A1 * | 2/2018 | Tsumura | B27B 17/025 30/387 |
| 2018/0043566 | A1 * | 2/2018 | Liliegard | B27B 17/025 30/387 |
| 2018/0043567 | A1 * | 2/2018 | Johansson | B27B 17/14 30/387 |
| 2018/0050463 | A1 * | 2/2018 | Johansson | B27B 17/04 30/387 |

FOREIGN PATENT DOCUMENTS

| | | | | |
|---|---|---|---|---|
| CA | 2795488 | A1 * | 10/2011 | B27B 17/025 |
| DE | 3504698 | | 8/1986 | |
| DE | 3542476 | A1 * | 6/1987 | |
| EP | 1502718 | | 2/2010 | |
| EP | 3199313 | A1 * | 8/2017 | B27B 17/14 |
| FR | 722595 | | 3/1932 | |
| FR | 2695857 | A1 * | 3/1994 | |
| JP | 01105702 | A * | 4/1989 | |
| WO | WO 2009098699 | A1 * | 8/2009 | |
| WO | WO 2011014380 | A1 * | 2/2011 | B27B 17/14 |
| WO | WO 2011014396 | A1 * | 2/2011 | B27B 17/02 |
| WO | WO 2011129843 | A1 * | 10/2011 | B27B 17/025 |

OTHER PUBLICATIONS

Chariot, David, Supplementary European Search Report, dated Jun. 30, 2017, 8 pages, European Patent Office, The Hague.

* cited by examiner

CHAIN BAR APPARATUS AND METHODS AND TOOL COMBINATIONS AND METHODS OF MAKING AND USING MOVING TOOL COMBINATIONS

CROSS REFERENCE TO RELATED APPLICATIONS

This application is a National Stage of International Application No. PCT/US10/042822, filed Jul. 21, 2010, and claims priority to U.S. Provisional Application No. 61/325,267 filed Apr. 16, 2010, the content of all of which is incorporated herein by reference.

BACKGROUND

Field

These inventions relate to chain bars and other support structures for chain cutting instruments and also supports for conveyors or moving tools, for example chain bars for cutting chains.

SUMMARY

Methods and apparatus are disclosed that can be used for chain bars or other support structures (sometimes hereafter referred to as "chain bars") for chain cutting instruments. One or more aspects of the methods and apparatus can be used to improve the manufacture of such structures, as well as to improve the structures themselves. In at least one aspect, the manufacturing cost for a chain bar can be reduced. In at least one aspect, the manufacturing of a chain bar is simplified.

In one example described herein, a chain bar is formed as a laminate of at least two structures, namely an outer plate and a core. The core is configured to extend substantially in the same manner as the outer plate, so that for example the outer plate is formed to be substantially planar, and a substantial portion of the core is also formed to be substantially planar. The core is also formed to include at least one passageway extending through the thickness of the core, such as from one side of the core adjacent the outer plate to the other side of the core opposite the outer plate. In one example, the at least one passageway is formed as a closed circuit not extending to any outer perimeter of the core. An example of a closed circuit includes a nonlinear opening, for example but not by way of limitation an opening having opposing walls spaced apart from each other substantially a constant distance. Another example is a non-circular opening extending in a given direction without intersecting a perimeter portion of the core. A further example includes an opening that is asymmetric, and one example of an asymmetric opening includes a serpentine opening. Other configurations of openings may also be used, in addition to or as a substitute for the openings described. In one example, at least one opening is formed in a core of a chain bar and the chain bar is assembled with adhesive extending into the at least one opening. In a further example, adhesive used in constructing a chain bar extends entirely through an opening in the chain bar from one side of the chain bar to another side of the chain bar.

In another example of a laminated chain bar having at least an outer plate and a core, at least one opening extending completely through the core is a laser cut opening. In a method of forming a core for a chain bar, the chain bar includes a core having an opening formed through a laser cutting operation. In one example, the opening is formed so as to be completely internal to a perimeter of the core. In another example, an opening is formed through the core by laser cutting an opening having opposing walls spaced apart from each other a substantially constant distance, and in one example, the opening follows a serpentine path. Many if not all of the openings through the core described herein can be formed in the core by laser cutting. Other methods of forming the openings described herein may also be used.

In a further example of a laminated chain bar having at least an outer plate and a core, water channels or other cooling fluid flow channels may be formed in the core, and adjacent segments of the core can be maintained at a constant spacing from each other even though they are separated by a respective flow channel extending completely through the thickness of the core. In one example, spacing between adjacent segments of the core can be maintained by removable tabs or other spacer elements that can be removed after adjacent core segments are positioned as desired. In one example, flow channels are formed between adjacent core segments and removable spacer elements are formed to maintain a desired spacing between adjacent segments. Forming the channels and/or the tabs can be carried out by laser cutting or other forming techniques. In one example, at least one removable spacer is formed between adjacent core segments and attached at a perimeter portion of the core. In another example, at least one removable spacer is formed to be attached between adjacent core segments interior to a perimeter portion of the core. In a further example, core segments and an adjacent outer plate or plates are assembled and secured together using registration pins and adhesive or other securing means. Other and/or additional steps may be followed to form a core for a chain bar having flow channels that extend completely through the core from one side of the core to an opposite side of the core.

In another example of a laminated chain bar having at least an outer plate and a core, one or both of the outer plate and the core include flow channel configurations having varying flow, for example flow cross-section, configurations as a function of location on the chain bar. The location on the chain bar may be distance from a flow inlet, relative proximity to a flow outlet, relative proximity to a flow branch or other location configurations. In one example, the flow cross-sectional area decreases with distance from a flow inlet. In another example, diversion devices or barriers are placed adjacent flow inlet areas to affect flow in the area of the inlet. Other configurations can be adopted. In another example, an inlet manifold area is optimized for continuous fluid flow, for example with more gradual curvature, shallower angles, or other surface configurations to minimize turbulent flow.

In a further example of a laminated chain bar having at least an outer plate and a core, flow channels can be defined entirely in the core, though the outer plate may form one side of one or more flow channels. For example, an inlet manifold, longitudinal flow channels and lateral flow channels may be formed entirely in the core. Additionally, flow channels to a nose sprocket assembly may also be formed completely in the core, though one side of a flow channel for the sprocket assembly may be defined by a portion of the sprocket assembly or its housing. In one example, a flow channel for the nose sprocket assembly may be formed in a portion of the chain bar core that extends forward and outward of the plane of the core and into a plane of the outer plate. In another example, fluid flow channels through the chain bar flowing to the nose sprocket and to the chain are formed as grooves, channels or other depressions in to the surface of a core element for the chain bar.

In another example of a laminated chain bar having at least an outer plate and a core with fluid flow paths, one or more of the flow paths may include flow diverter's, flow barriers, flow vanes or flow islands within a flow path. These flow structures affect the flow within the flow path. For example, a flow structure can reduce turbulence, direct flow into a lateral channel, direct flow into a central channel, change flow pressure or velocity, or otherwise affect flow characteristics in the flow channel. The flow structure can be configured as a function of the desired flow characteristic at the flow location.

In a further example of a laminated chain bar having a core with fluid flow paths, the chain bar can include one or more flow control valves. In one configuration, a flow control valve is used to prevent backflow. For example, in many chain bars, only one of two flow inlets is used at any given time, and a flow control valve can be used to reduce fluid flow to the unused inlet. A flow control valve can be active or passive. In one example, the valve configuration can be set by the predominant inlet flow configuration. In another example, the valve configuration can be set manually, hydraulically, electronically or through other means.

In an additional example of a laminated chain bar having at least an outer plate and a core, the outer plate and core may include one or more inter-engagement elements. In one example, elements on the core may fit into complementary elements in the outer plate, for example bosses on the core fitting into complementary openings in the plate. The bosses and complementary openings may be circular, polygons, asymmetric structures or other configurations. All of a first structure type may be on one of the outer plate and core and all of the complementary structures can be on the other, or the first and complementary structures may be distributed as desired between the outer plate and core. The inter-engagement elements help with registration of the adjacent components and also help with structural integrity of the combination. Such inter-engagement elements are also helpful with outer plate and core elements that are formed from materials different from each other.

In any of the examples described herein of a laminated chain bar, the core can be formed from a plastic unless another material is specifically identified, or it may be formed from a metal. A plastic core can be fiber reinforced, including with any of the materials that may be used to reinforce plastic. Other components of the chain bar can also be made from a number of materials including plastic, with or without reinforcement, or metal.

In another example of a laminated chain bar having a core and at least an outer plate, adhesive can be used to form the lamination. Adhesive can also be used to inhibit corrosion on corrosion-problem surfaces. For example, where the at least one outer plate is formed from metal, adhesive applied to the metal outer plate can help to inhibit corrosion. Where the adhesive is a thermoplastic or a thermoset resin, corrosion resistance may be improved over other adhesives. Corrosion resistance may also be improved by using a plastic core.

In a further example of a laminated chain bar having a core and at least one outer plate bonded together using adhesive, bonding strength can be improved by a core bonding surface that is other than uniformly smooth. For example, the core bonding surface can include a surface texture to improve bonding. In one example, the surface texture can be substantially random.

Another example of a laminated chain bar having a core and at least one outer plate has at least one flow channel formed in one or the other of the core and outer plate. The at least one flow channel includes spaced apart sides connected by a connecting structure. The connecting structure can be a bridge, a tab, a pin or other structure helping to keep the two sides apart. The connecting structure is removable, for example through weakened portions between the connecting structure and the adjacent side. The connecting structure can be disconnected by bending, twisting or other weakening motion resulting in disconnection. The connecting structure can be internal to an outer perimeter of the core or outer plate, as the case may be, or may be external to the outer perimeter. An internal connecting structure configuration may enhance the ease of disconnecting the connecting structure.

In an example of a chain bar laminated by placing a core and at least one outer plate adjacent each other, and where at least one flow channel includes spaced apart sides connected by a connecting structure, the laminate can be formed by placing the core and the outer plate adjacent each other so that the flow channel is maintained in a desired configuration by the connecting structure. The connecting structure can be maintained until the spaced apart sides of the flow channel are secured as desired and the flow channel configuration fixed. The connecting structure can then be removed, for example to fully open the flow channel as desired. The connecting structure can be any connecting structure, such as those described herein.

In an example of a method or process that can be used to assemble a chain bar, a core and at least one outer plate are placed adjacent one another where at least one or the other of the core and outer plate includes a flow channel having spaced apart side structures. The side structures are held spaced apart in a desired configuration by a connecting structure as the core and outer plate are laminated. The connecting structure can be removed, for example when the spaced apart structures defining the flow channel are fixed. The connecting structure can be removed for example by bending, twisting or other method for weakening the connecting structure. The connecting structure can be weakened by manipulating the connecting structure from a position outside the perimeter of the side structures defining the flow channel.

A component for a chain bar, for example a core or at least one plate for use in defining a flow channel for the chain bar, can be formed by forming connecting structures for connecting opposite side structures defining a flow channel. The connecting structures can be any of the connecting structures described herein as well as other structures achieving similar functions. The connecting structures can be formed in a number of ways, including laser cutting, water jet cutting, stamping or other forming processes. In one configuration, the connecting structure is formed with a bridge component extending between the spaced apart sides defining the flow channel and also with a manipulating portion connected to the bridge component for disconnecting the connecting structure from the sides defining the flow channel. The bridge component can be positioned within the flow channel, or outside the flow channel. The manipulating portion can extend outside the flow channel, for example outside a perimeter of the chain bar.

A chain bar and one or more components for a chain bar, for example, may be formed by laser cutting one or more laminate of the chain bar and bonding with adhesive or a flowing bonding agent at least a portion of the chain bar such that the adhesive or bonding agent extends at least partly into the laser cut. In another example, one or more components of a chain bar can be formed, for example by laser cutting a core element such that a flow channel extends the entire thickness of the core element. In a further example of a chain bar, a core element can be formed to have all of the flow channels formed in the core element, including those flow channels feeding fluid to a nose sprocket, for example. Flow channels can be formed to extend in the core element where a portion of the core element extends into a plane of a side plate. Flow channels can also be formed by forming one or more cavities or channels in an interior side of a side plate either to a partial depth or completely through the side plate, and fluid can flow into the cavity or channel. In other examples of methods for forming a chain bar, flow changing portions such as flow islands, diverter's or channel elements are formed within a flow channel to change the flow characteristics of the fluid around the channel element. Another method of forming a chain bar includes incorporating a flow control valve, for example a backflow valve into the chain bar. Another method of forming a chain bar may include incorporating bosses, or other inter-engagement portions for registering adjacent layers of a laminate with respect to each other. A further method of forming a chain bar may include using adhesive to protect components of the chain bar from the corrosive effects of fluid in the chain bar. Another method of forming a chain bar may include incorporating light producing components into the chain bar so that the light producing components can be used to illuminate a cutting area. In another method, a cutting area can be illuminated by a chain bar where the chain bar is formed at least in part from a translucent material that can transmit light from another part of the equipment.

In another example of a chain bar, light producing elements can be incorporated into the chain bar for illuminating a work area. In one example, LED light sources are mounted onto portions of the chain bar, for example embedded into openings in side surfaces of the chain bar, for illuminating the surrounding area. LED light sources can be powered by current supplied by conductors embedded in the chain bar, for example in fluid flow channels or embedded in a plastic core. Current can be supplied from a current source in the chainsaw, for example through conventional means such as a sparkplug or other electrical source, through a battery in the chainsaw or in the chain bar, through current generated by a pump in a flow channel of the chain bar or through other means. The light source may be turned on and off by a suitable switch, which may be manual, mechanical or some other form. In another example of elimination for a chain bar, a light source can be included in the chain bar or adjacent the chain bar and the chain bar formed from a translucent material that transmits light from the light source to the adjacent area.

A chain bar is an example of a structure that supports a moving structure, in that case a chain, for example for cutting workpieces such as concrete walls. In another example of a structure that can be used for supporting a moving structure, for example a chain bar, the support structure can have a support surface having surface discontinuities along a portion that supports the moving structure. The support structure can be a chain bar, for example for supporting a cutting chain, and the support structure can have an edge surface that is other than continuously straight. In one example, the edge surface can have a plurality of grooves formed or cut therein, forming ridges, plateaus or lands between the grooves. The chain or other moving structure rides along the exposed surfaces of the ridges, plateaus, lands or other raised formations between the grooves. The raised formations can have flat top supporting surfaces, rounded supporting surfaces or other surface geometries in the direction of motion of the moving structure. The raised formations can also be flat, rounded or have other geometries transverse to the direction of motion. In one example of the support structure, the raised formations have flat tops both in the direction of and transverse to the motion, and separated from each other by respective grooves, cuts, depressions or other recessed formations. The recessed formations can take a number of configurations, and can be equally spaced or non-uniformly spaced, have the same dimensions as each other or different dimensions, have straight angled sides or curved angled sides, substantially vertical sides, flat bottoms, rounded bottoms or other geometries. In one example, the recessed formations have relatively straight angled sidewalls, for example at about 60° from a vertical line, and join adjacent raised formations over a curved or radiused surface and have a curved or radiused bottom surface. In another example, the raised formation occupies a surface area approximately twice the projected surface area of the recessed formation. For example, for a given thickness of a support surface, the raised formation extends in the direction of movement of the moving structure a distance of approximately twice the distance occupied by a recessed formation in the direction of movement.

In a further example of a structure that can be used for supporting a moving structure, for example a chain bar for supporting a moving chain, the structure can support moving tools such as cutting tools, for example cutting chains. The support structure can have a support surface having surface discontinuities, and the surface discontinuities can be formed by laser cutting the support surface. The support surface can be a metal support surface, and the surface discontinuities can be created by laser cutting, for example laser cutting recessed formations to define a series of recessed formations separating raised formations to be used for supporting the moving structure. The laser cutting process can result in heat treating the metal support surface. The metal support surface can be heat-treated to a known depth, including in some instances by laser heat treating, and the heat treatment can result in reduced wear when the moving structure moves across the raised formations. Heat treatment of the metal support surface to a known depth allows targeted or controlled heat treatment to desired areas.

In an example of a laser cut support structure for supporting moving tools such as cutting tools, the support structure can be a laminated structure secured with adhesive. For example, the support structure can include an outer plate or side plate along with a core, and the side plate can be laser cut or otherwise formed to have a desired configuration. Where the side plate is a metal side plate, the side plate can be heat-treated so as to have the desired hardness or other structural characteristic. The side plate can then be laser cut to provide the desired final geometry, and the side plate adhered, bonded or otherwise affixed to the core, as desired. The laser cutting for the final geometry can be done before or after assembly with the core, but in the example of a chain bar that might have a core and a pair of side plates on each side of the core, laser cutting for the final geometry can be done before assembly with the core, for example where the side plate geometries might not be mirror images of each other. In one example, one or more side plates, for example for a chain bar cutting assembly, may be laser cut to a final geometry to include a plurality of edge discontinuities. In one example, the edge discontinuities include raised formations and separated by recessed formations, for example land formations and groove formations. In one example, the land and groove formations in one side plate are linearly or longitudinally offset from adjacent lands and grooves in the other side plate on final assembly. An adhesive laminated chain bar assembly in several examples of structures described herein can have laser cut final edge of geometries without requiring additional processing steps common with spot welded chain bars. For example, induction rail heat treating and subsequent straightening or flattening can be eliminated. Additionally, some or all grinding steps for a chain bar groove can be eliminated.

In another example of a structure that can be used for supporting a moving structure, for example a chain bar for supporting a moving chain, the support structure can be formed from a plurality of support structures each having discrete support surfaces. For example, in first and second support structures, each of the first and second support structures have their own support surfaces. The first and second support structures can be spaced apart, and the first and second support structures can have respective raised formations and separated by respective recessed formations. The recessed formations on one support structure can be directly opposite corresponding recessed formations on the other support structure, or they may be staggered or shifted relative to each other, for example in the direction of movement of the moving structure. In one example, the support can be a chain bar having first and second spaced apart support plates on opposite sides of a core element, and the first and second support plates can have respective raised and recessed formations. In one example, each of the raised formations can have flat exposed surfaces and each of the recessed formations can be angle-sided grooves. In another example, the recessed formations on one support plate can be transversely opposite raised formations on the other support plate. The support plates can be metal support plates, and raised formations and recessed formations can be formed in each of the support plates through laser cutting, for example to produce any of the geometries described herein. The edges of each of the metal support plates can be heat-treated to a known depth, for example approximately 0.020 inch from any exposed surface. For example, the edges of the metal support plates can be heat-treated to the known depth inward from the exposed surface of a land (for example normal to the land surface), inward from the exposed surface of a side of a groove (for example normal to the groove surface) and inward from the exposed surface of the bottom of a groove (for example normal to the groove bottom surface). With such a configuration, wear of the heat-treated surface is reduced, such as might occur with a cutting chain, and the initial wear of an exposed surface simply exposes new heat-treated surface. Additionally, to the extent a groove surface is also heat-treated to a known depth, such known depth extends partly underneath the heat treatment of the adjacent raised formation, thereby enhancing the heat treatment depth below the surface of the raised formation. The raised and recessed formations can have a number of geometries, including serpentine, flats and angled or rounded grooves, curved or rounded raised formations, as well as other configurations.

In another example, a support structure, for example a support structure such as a conveyor bar that may be used to support a chain or other moving cutting element, can be formed by cutting into a peripheral edge of the support structure to form alternating raised and recessed formations. The raised and recessed formations can have any of the geometries and configurations described herein. The peripheral edge of the support structure can be formed by laser cutting. Where the support structure is a metal support structure, laser cutting of the peripheral edge of the support structure provides heat treating of the exposed edge to a known depth. In one example, a chain bar can be formed by laser cutting surface discontinuities or otherwise forming a non-straight edged support surface for a chain. In one chain bar configuration, surface discontinuities are formed in a plurality of support structures and the support structures assembled into a chain bar on each side of a core structure. In one example, the support structures are positioned relative to each other so that the surface discontinuities on one support structure are staggered or shifted relative to those on the other support structure. In a further example, at least one support structure is cut to have relatively flat raised formations separated by respective slope-sided grooves. The raised formations and grooves have exposed surfaces that are heat-treated to a known depth. The chain bar is configured so that the chain can wear the chain bar down to the known depth and the chain bar then refurbished, replaced or discarded.

In a further example, a support structure, for example one for a moving cutting element, is used to support the moving cutting element. The support structure is configured so that the moving cutting element makes intermittent contact with a portion of the support structure, for example when the cutting element moves along a raised formation and then over a recessed formation without contacting a surface in the recessed formation. Wear of the support structure can be reduced, and the rate of degradation of the support surface may also be reduced. In one example, the support structure is a chain bar supporting a cutting chain, and the cutting chain rides along raised formations on the edge surfaces of spaced apart support plates, for example making contact with the tops of the raised formations while riding above the recessed grooved surfaces.

In another example, a support structure, for example one for a moving cutting element, supports a continuously moving cutting element. The cutting element cuts a workpiece while moving along the support structure, and discrete portions of the cutting element repeatedly make and break contact with the underlying support structure. In one example, contact occurs between the cutting element and the support structure at raised land formations, and contact is broken when a portion of the cutting element passes over a recessed formation area. As the cutting element cuts the workpiece, the raised land formations support the cutting element while side surfaces of the grooves are not contacted by the cutting element. In one configuration, the support structure is a chain bar having spaced apart support structures, each having raised land portion separated by recessed grooved areas. During a cutting operation, a cutting chain is in contact with a raised land formation on a first support structure while it is passing over a recessed groove area on a second support structure. Additionally, the cutting chain is in contact with a raised land formation on the second support structure while passing over a recessed groove area on the first support structure. Such cutting method promotes extended chain bar lifetime and may reduce generation of heat during cutting.

In another example, a support structure, for example one for a moving cutting element, supports a continuously moving cutting element. During operation and motion of the cutting element over the support structure, raised formations in the support structure wear down while recessed surfaces in adjacent grooves do not wear appreciably because there is little or no contact with the recessed surfaces by the cutting element. As cutting continues, raised formations may wear, but the support structure can be configured so that material forming the raised formations are heat-treated. Wear can occur along relatively flat raised land formations or on other exposed surface geometries.

These and other examples are set forth more fully below in conjunction with drawings, a brief description of which follows.

DETAILED DESCRIPTION

Figure 1:
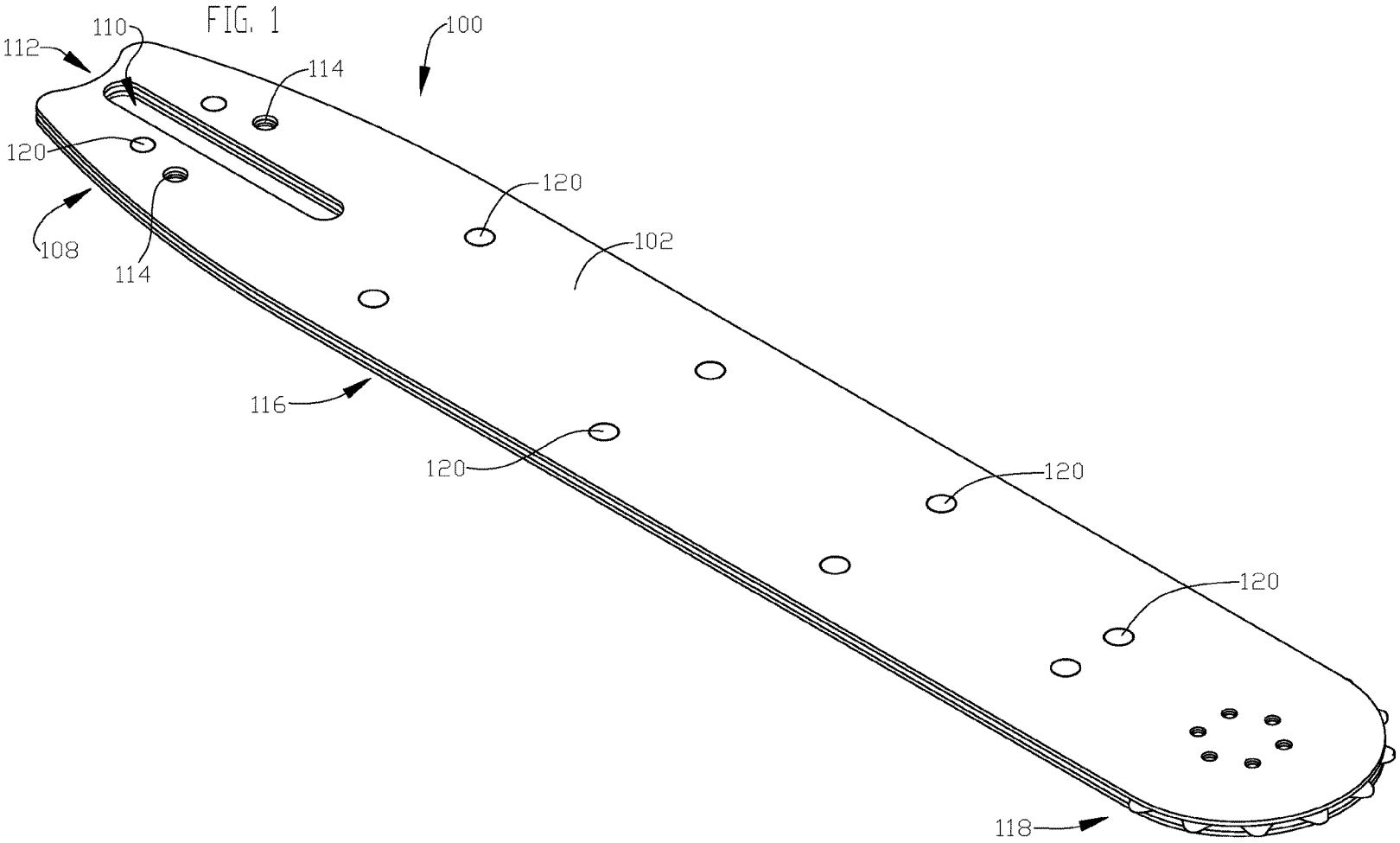
FIG. 1 is an upper right isometric view of a chain bar assembly in accordance with one example described herein.

This specification taken in conjunction with the drawings sets forth examples of apparatus and methods incorporating one or more aspects of the present inventions in such a manner that any person skilled in the art can make and use the inventions. The examples provide the best modes contemplated for carrying out the inventions, although it should be understood that various modifications can be accomplished within the parameters of the present inventions.

Examples of tool components and of methods of making and using the tool components are described. Depending on what feature or features are incorporated in a given structure or a given method, benefits can be achieved in the structure or the method. For example, tool components using fluid for cooling may achieve better cooling and longer lifetime. Cutting tool components may also benefit from lighter-weight components, lower-cost and reduced wear.

Tool components that use water for cooling and/or lubrication may benefit also from one or more features described, for example reducing the possibility of corrosion. Improved corrosion prevention characteristics help component life and promote tool integrity.

Tool components that use water for cooling and/or lubrication may benefit also from one or more features described, for example reducing the possibility of fluid pressure variations adversely affecting the integrity of the tool. Improved fluid pressure characteristics lead to more predicable operation and also promotes tool integrity.

In tool components similar to chain bar configurations, one or more aspects of the examples described may allow better cooling and heat transfer, and improved tool performance. In support structures for moving tools, such as cutting or abrading tools moving along a guide or track and for example at high speed over the guide (such as between 2000 and 6000 linear feet per minute, defined for present purposes as high speed), the support structure can show reduced wear by having surface discontinuities or raised and recessed formations. Where the support structure is laser cut for example, the area supporting the moving tool experiences heat treating of the material, thereby improving the resistance to wear. By way of further example, the wear rate may be reduced.

These and other benefits will become more apparent with consideration of the description of the examples herein. However, it should be understood that not all of the benefits or features discussed with respect to a particular example must be incorporated into a tool, component or method in order to achieve one or more benefits contemplated by these examples. Additionally, it should be understood that features of the examples can be incorporated into a tool, component or method to achieve some measure of a given benefit even though the benefit may not be optimal compared to other possible configurations. For example, one or more benefits may not be optimized for a given configuration in order to achieve cost reductions, efficiencies or for other reasons known to the person settling on a particular product configuration or method.

Examples of several tool configurations and of methods of making and using the tool components are described herein, and some have particular benefits in being used together. However, even though these apparatus and methods are considered together at this point, there is no requirement that they be combined, used together, or that one component or method be used with any other component or method, or combination. Additionally, it will be understood that a given component or method could be combined with other structures or methods not expressly discussed herein while still achieving desirable results.

It should be understood that terminology used for orientation, such as front, rear, side, left and right, upper and lower, and the like, are used herein merely for ease of understanding and reference, for example with reference to views in the drawings, and are not used as exclusive terms for the structures being described and illustrated.

A tool component in the form of a chain bar 100 (FIGS. 1-4) is formed as a laminate of two or more components for supporting a cutting chain. The chain bar can be used as part of a chainsaw for cutting wood, concrete or other workpieces, as would be known to one skilled in the art. The assembly and use of a chainsaw with chain bars are well known to those skilled in the art and will not be considered in detail. However, it should be understood that the chain bars described herein can be used with a number of chainsaw configurations as would be appreciated by one skilled in the art.

The chain bar 100 includes a first or top (as viewed in FIGS. 1 and 4) side plate 102 and a second or bottom side plate 104 (as viewed in FIG. 4) forming with a core 106 a laminated chain bar. The chain bar 100 by a chainsaw motor at a mounting end 108 having a mounting and support slot 110, a drive sprocket area 112 for accommodating a drive sprocket and a pair of fluid inlet openings 114. The fluid inlet openings 114 receive fluid such as water for cooling the chain bar and cooling and lubricating the chain bar groove 116 that supports and guides the cutting chain (not shown), and for cooling and lubricating the nose sprocket 118. Additionally, any fluid exiting the chain bar in the area of the cutting chain also cools and lubricates the cutting chain. Because the chain bar 100 is reversible, two fluid inlet openings 114 are provided, only one of which is used at any given time for supplying fluid to the chain bar. The other of the fluid inlet openings receives a chain tightening mechanism to adjust the chain tension. The chain bar laminate assembly is formed so that the chain bar groove 116 has the conventional configuration.

Figure 2:
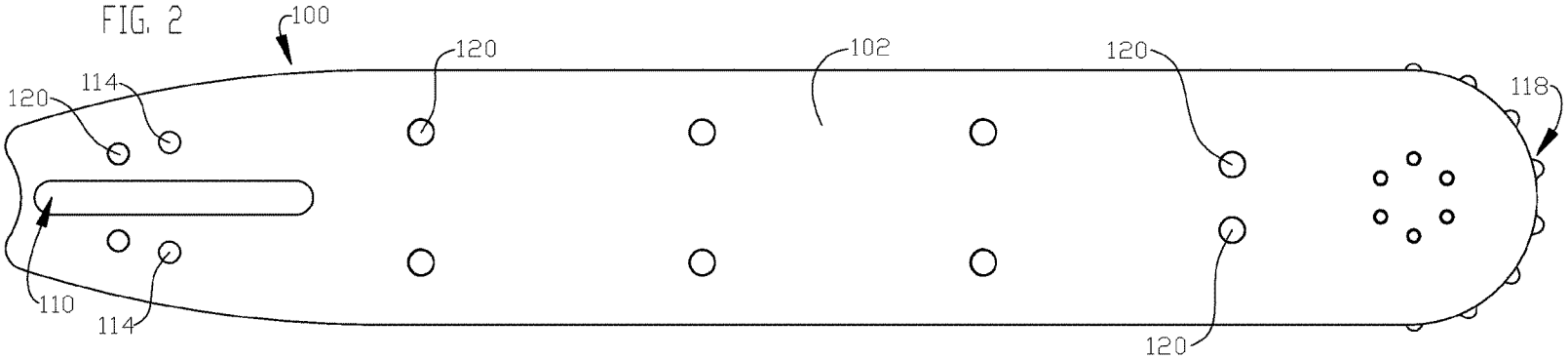
FIG. 2 is a top plan view of the chain bar assembly of FIG. 1.
Figure 3:
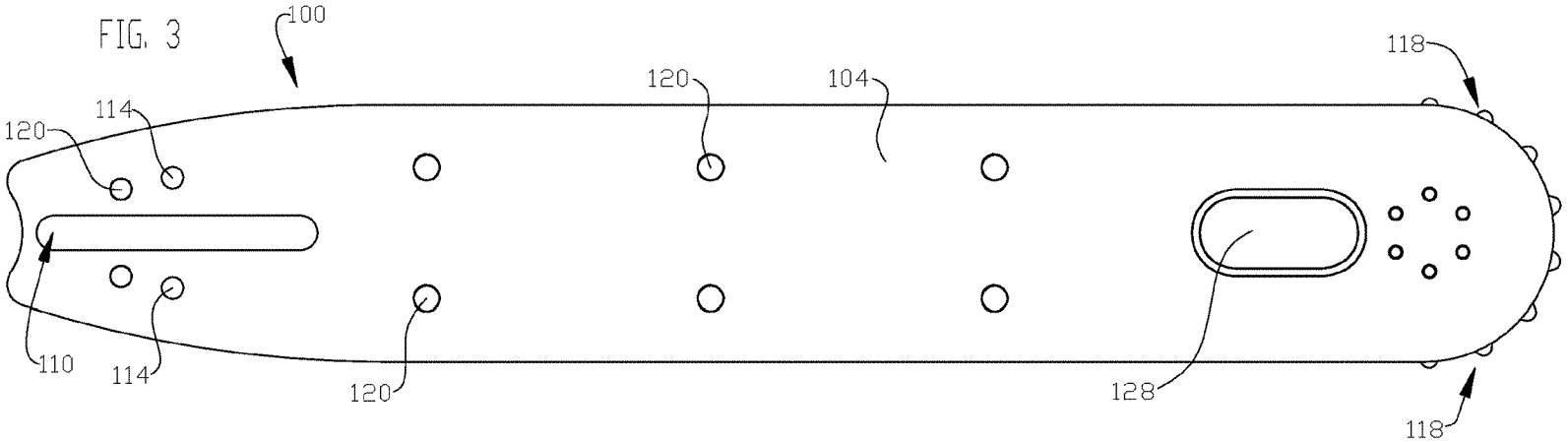
FIG. 3 is a bottom plan view of the chain bar assembly of FIG. 1.

In the example of the chain bar 100 shown in FIGS. 1-12, the chain bar includes a plurality of inter-engagement elements. The inter-engagement elements help to laminate the components of the chain bar to form the final chain bar assembly. The inter-engagement elements help to register adjacent planar components relative to each other. They also help to strengthen the structure, for example by improving the sheer strength of the laminate. In the present examples, the inter-engagement elements are formed from complementary elements in the outer plate 102 and 104 with components in the core 106. In the present example, the inter-engaging elements include a plurality of bosses 120 distributed substantially symmetrically about a central longitudinal axis bisecting the mounting and support slot 110. As shown in FIGS. 1-3, the bosses 120 extend into the side plates 102 and 104. The bosses are also shown in FIGS. 5-10. The bosses extend substantially outward from the core 106, and each of the bosses extend in one direction from the corresponding side of the core 106 opposite a similarly located and configured boss extending outward from the opposite surface, except for the pair of bosses at the nose end of the core 106. The bosses 120 at the nose end are positioned on the core 106 to extend only from the top surface, as viewed in FIG. 5.

The bosses 120 form part of inter-engagement elements to improve the assembly and the structural integrity of the chain bar. Each of the upper and lower side plates 102 and 104 include openings 122 complementary to the respective bosses on the core 106. The openings and the bosses provide registration for adjacent layers and also improved sheer strength for the chain bar. The inter-engagement elements can be shaped to be circular, polygon, asymmetric or other configurations complementary to each other. Other structures in the laminate may also be complementary to each other. While all of the bosses are shown as being located on the core 106 and all of the complementary openings on the first and second side plates 102 and 104, it should be understood that all of the bosses can be on the side plates, or some on the side plates and some on the core with respective complementary inter-engagement elements positioned as appropriate.

The nose sprocket 118 is a conventional sprocket for supporting the chain. The sprocket is supported for movement on bearings 124 (FIG. 4) about a hub 126 secured between the first and second plates 102 and 104 in the conventional manner. The bearings and the sprocket are cooled with fluid from the fluid inlet openings 114.

The first side plate 102 in the present example is substantially flat on both sides and includes the openings as indicated. The second side plate 104 is also substantially flat and substantially the same thickness as the first side plate 102, and includes the openings as indicated. In addition to the slot 110, water inlet openings 114, the complementary openings 122 and the openings for securing the nose sprocket, the second side plate 104 includes an opening 128 (FIGS. 3-4) for receiving and supporting a portion of the core 106, described more fully below. The opening 128 provides space for the portion of the core 106 to extend out of the plane of the core. The opening 128 is substantially oval in the present example. The first and second side plates in the present examples are metal, as in conventional side laminates.

The core 106 (FIGS. 4-12) has a substantially flat bottom surface 130 except for a projection in the form of an outlet manifold 132 (FIGS. 5-7 and 9-10). The outlet manifold 132 extends into the oval opening 128 in the second side plate 104, as described more fully below. The bosses 120 extend substantially normal to the respective surface of the core 106, and our substantially circular in the present examples. The core includes respective water inlet openings 134, corresponding to the water inlet openings 114. The sides of the core other than the distal portion corresponding to the outlet manifold 132 conform substantially to the site configurations of existing chain bar cores, for supporting a cutting chain. Additionally, except for the bosses 120, the outlet manifold 132 and the flow channels described more fully herein, the thickness of the chain bar core 106 is substantially similar to existing chain bar cores.

The core 106 may be formed from a number of materials, including metal, plastic, composite materials and the like. In the present example, the core is formed from a fiber reinforced plastic. In one configuration, the core has good strength characteristics in compression, and the bosses provide good sheer strength. The plastic core is easily formed through conventional molding techniques having the configurations described herein.

The core includes an inlet manifold area 136 (FIGS. 6 and 11) with an inlet channel 138 corresponding to each of the inlet openings 134. The inlet channel 138 has a relatively large cross-sectional area for flow and has a relatively gradual curvature to a flow junction 140. As in substantially all of the flow channels of the chain bar in the present example, the flow cross-sectional area is determined by the depth and width of the flow channel formed into plastic core. The remaining side of the flow channel is closed by the adjacent first plate 102 and the adhesive (not shown) between the two. The flow junction 140 extends from an apex point 142 to an exit area 144, at which point fluid flow continues down a substantially central channel 146, as described more fully below. The gradual curvature of the flow inlet to the junction 140 has a substantially constant radius of curvature to the junction, and minimizes abrupt bends or sharp corners. The cross-sectional flow area of each inlet channel 138 is substantially constant from the respective inlet opening 134 to the apex 142.

Figure 4:
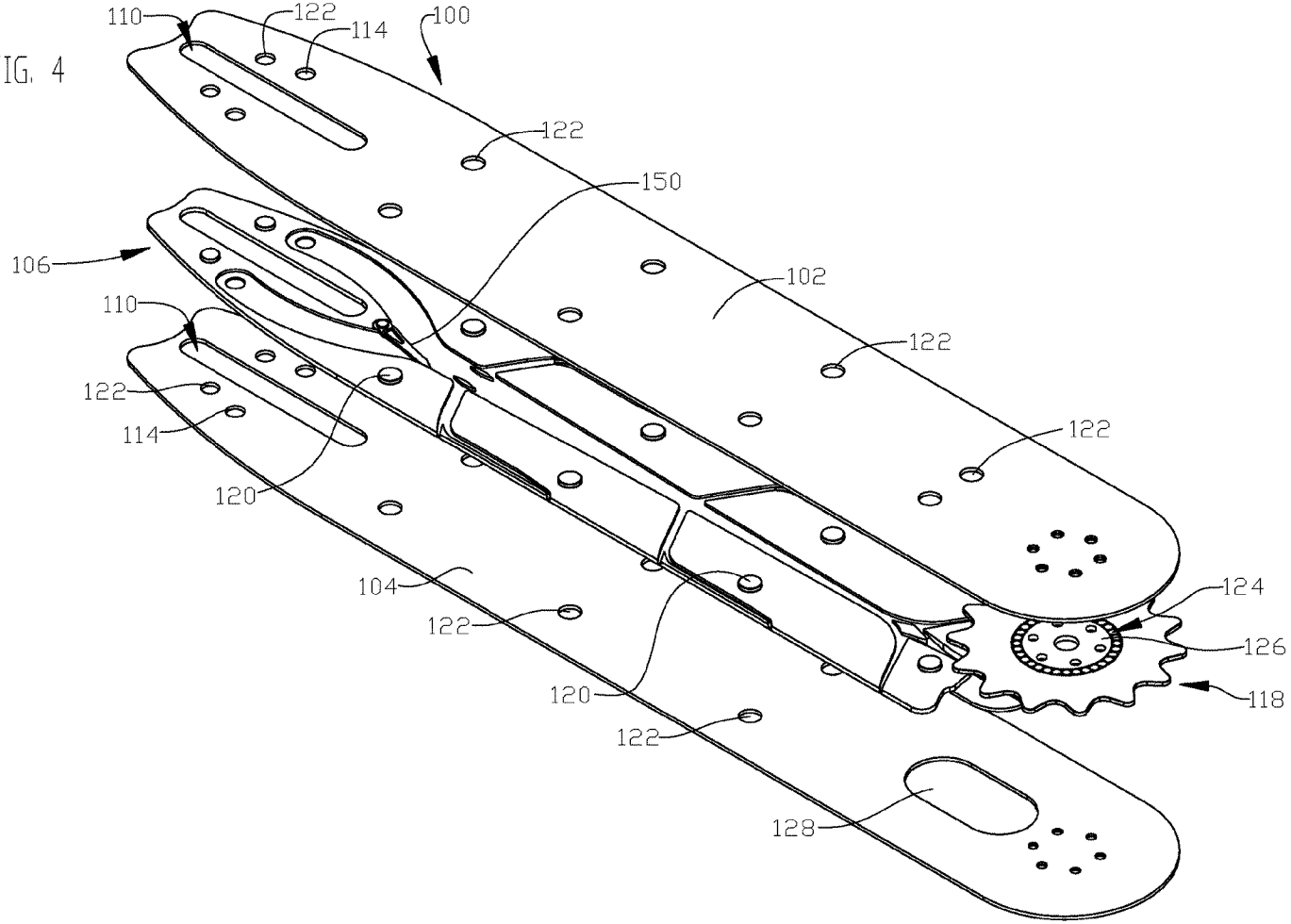
FIG. 4 is an exploded view of the chain bar assembly of FIG. 1.
Figure 15:
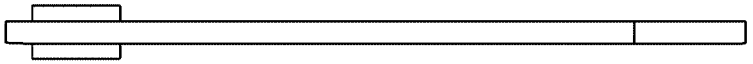
FIG. 15 is a side elevation view of a flow valve in the chain bar shown in FIG. 4.
Figure 16:
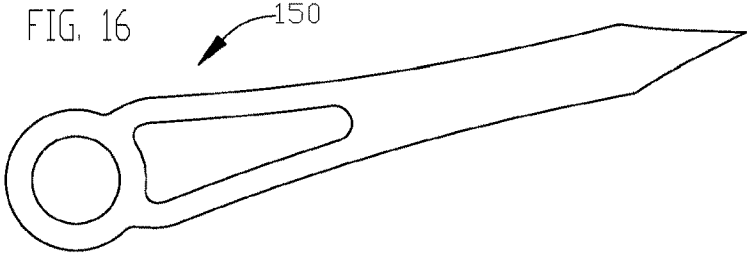
FIG. 16 is a top plan view of the valve of FIG. 15.
Figure 17:
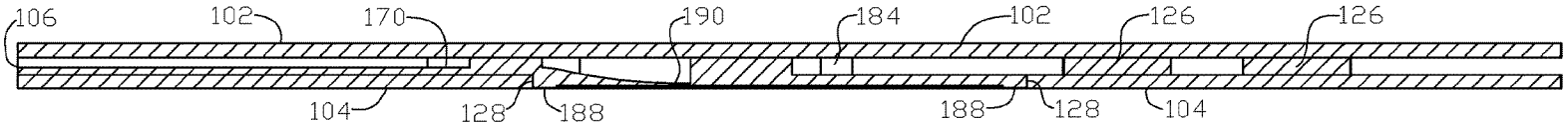
FIG. 17 is a cross-sectional view of a right end of a chain bar assembly omitting the nose sprocket.

The apex point 142 includes an opening 148 for receiving and supporting a flow valve 150 (FIGS. 4 and 15-16). The flow valve 150 pivots freely in the junction area 140 is a function of the direction from which fluid flow is coming. The flow valve 150 serves as a backflow valve reducing the amount of fluid flowing from the inlet channel 138 into the opposite inlet channel 138 (not presently in use for fluid flow). The flow valve also promotes better flow in the remainder of the channel, for example by reducing flow eddies or cavitation.

The central channel 146 extends substantially along a medial or longitudinal axis of the chain bar core. The flow cross-sectional area gradually decreases in the distal direction to the distal end and the outlet manifold 132. The cross-sectional flow area decreases in width but not substantially in depth out to the distal end portion of the core.

Figure 14:
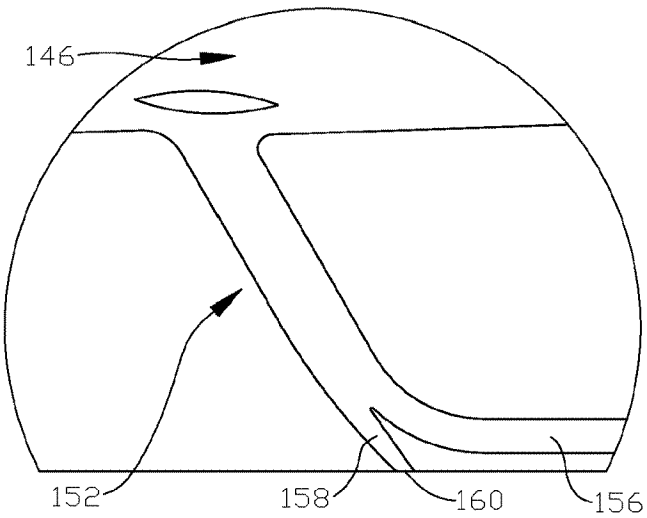
FIG. 14 is a detail of a top plan view of the chain bar core of FIG. 6.

Considering the various flow paths in further detail, each side of the core from the media line includes to flow branches 152 and 153, each of which branch again before reaching the lateral edge 154 of the core forming the outer perimeter of the core. Each of the respective branches have respective flow cross-sectional areas less than the upstream flow area from which it came, to maintain flow pressure and velocity for example. As shown in FIG. 14, a first branch 152 from the central channel 146 extends substantially straight at an angle from the central channel to a second smaller branch 156 and to a still smaller branch 158 terminating at an outlet port 160. The second smaller branch 156 terminates in a further outlet port 162 (FIGS. 5-6 and 8) further along the perimeter of the core from the outlet port 160. A similar flow channel arrangement is on the opposite side of the central channel, including with comparable cross-sectional flow areas. The flow branches 153 downstream from the first pair of flow branches 152 have a similar layout but smaller flow cross-sectional areas.

Figures 5, 6, 7, 8, 9, 10:
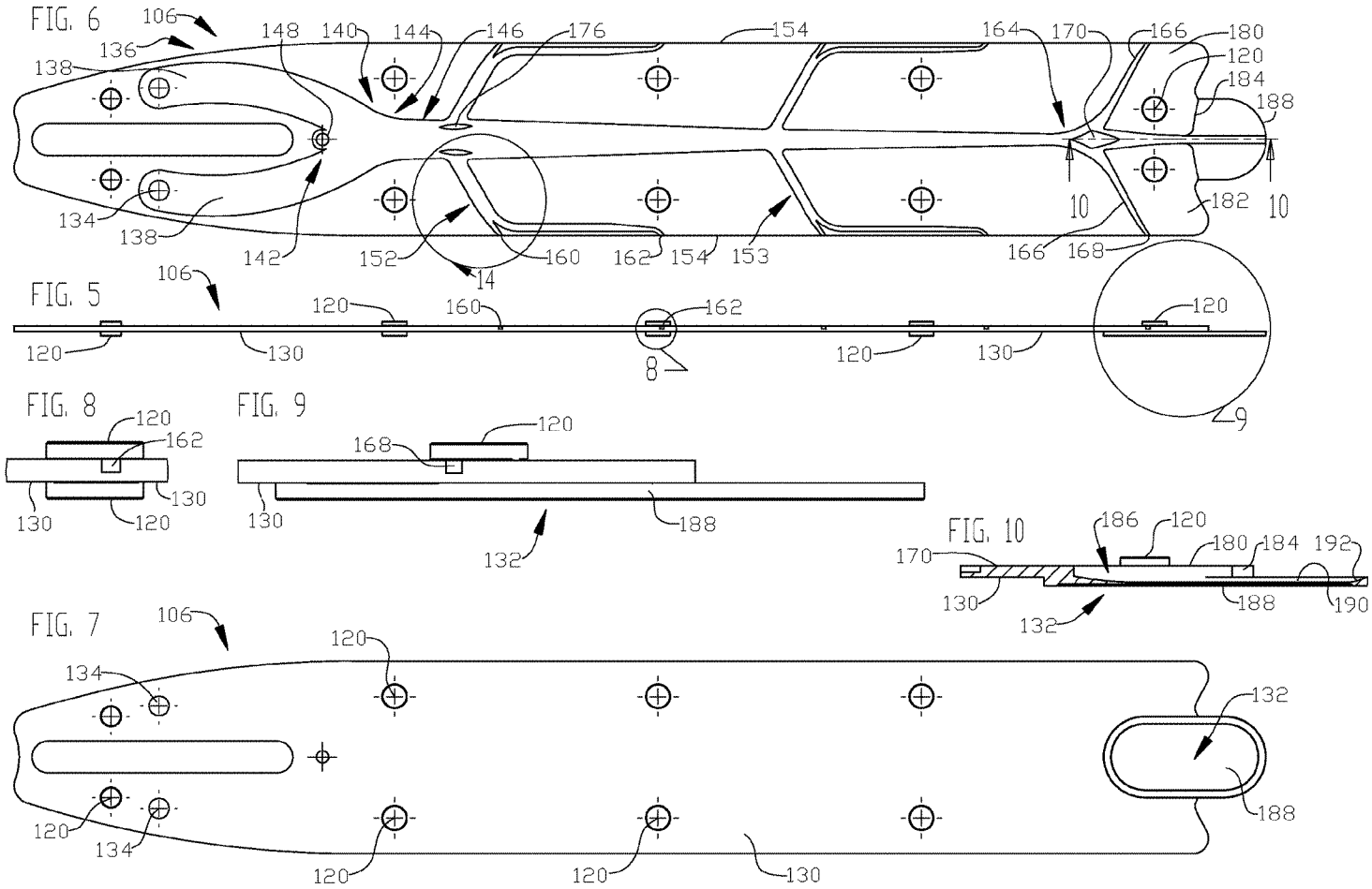
FIG. 5 is a front elevation view of a core element of the chain bar assembly of FIG. 1.
FIG. 6 is a top plan view of the core element of FIG. 5.
FIG. 7 is a bottom plan view of the core element of FIG. 5.
FIG. 8 is a detailed view of a portion of the side of the chain bar core of FIG. 5 showing upper and lower bosses and a fluid flow channel.
FIG. 9 is a detailed view of a portion of the side of the chain bar core of FIG. 5 showing the nose end portion of the core.
FIG. 10 is a partial cross-sectional view of the core of FIG. 5 taken along line 10-10 of FIG. 6.
Figure 11:
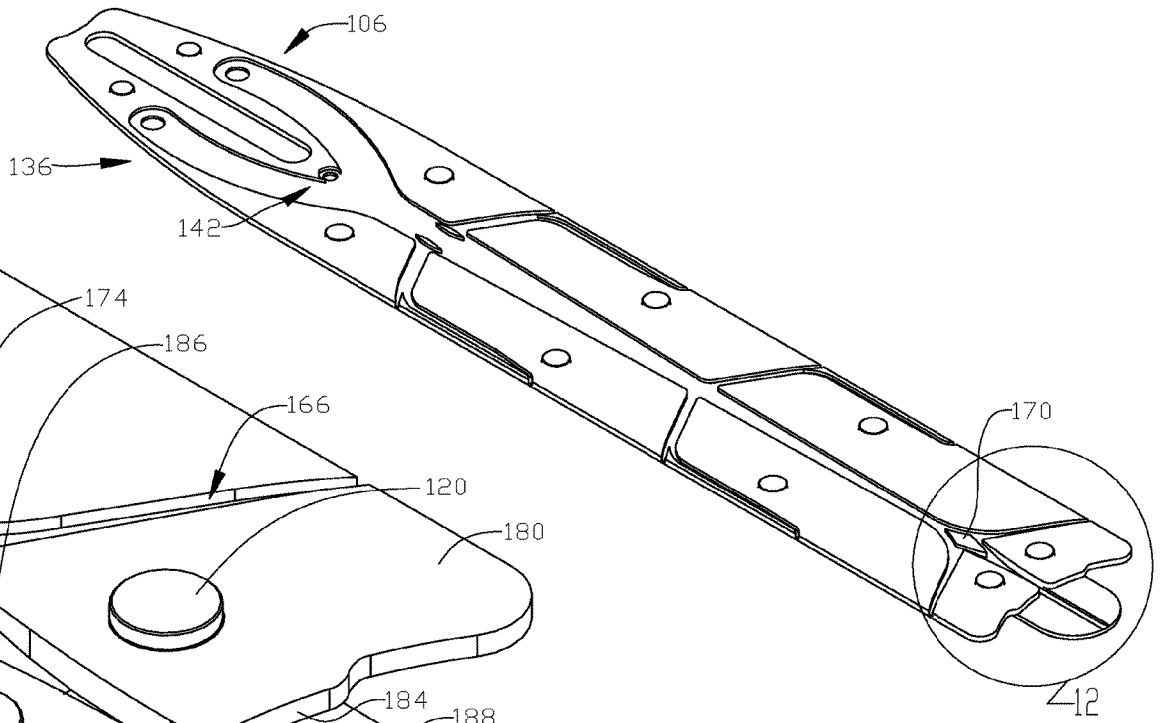
FIG. 11 is an isometric view of the core of FIG. 5.

As the central channel 146 approaches the distal end of the core, the cross-sectional flow area continues to decrease to a third flow diversion 164, in the present example. Respective side flow branches 166 having a smaller cross-sectional flow area than the flow branches 152 and 153, respectively, terminate at respective flow outlets 168 (FIGS. 6 and 9). The side flow branches 166 extend away from a flow diversion element 170 (FIGS. 6, 10, 11-13 and 17). The flow diversion element 170 may be an island, flow channel projection or block or some other element for diverting fluid flow. The flow diversion element 170 helps to promote laminar flow, helps to do for fluid flow to the side perimeter 154 of the chain bar core, and in the present example through surface tension and pressure promotes fluid flow to the nose sprocket assembly. The flow diversion element 170 includes a pair of substantially concave upstream flow surfaces 172 and a pair of downstream slightly convex surfaces 174, forming a somewhat elongated diamond-shaped island. The distal flow diversion element helps to maintain flow pressure at the distal end portion of the core.

Upstream flow islands or flow diversion elements may also be included. For example, flow diversion elements 176 (FIG. 6) are positioned substantially across the openings of the flow branches 152. These flow diversion elements 176 are narrower than the flow diversion element 117 downstream. The diversion elements 176 promote laminar flow and direct flow. The flow diversion element 176 on the opposite side of the flow Inlet channel 138 from which fluid flows helps to direct flow from that side, as does the flow valve 150. For example, the flow diversion element 176 redirects fluid flow from the Inlet channel 138 along the central channel so that the newly incoming fluid flow from the opposite side inlet channel does not flow predominantly out the opposite flow branch 152. Additionally, the opposite flow diversion element 176 may help to encourage flow into the respective flow branch. Other flow diversion elements may be placed as desired to encourage or promote a desired flow pattern. Additionally, further flow outlet ports may be included in the core to improve fluid flow to the cutting chain.

Figure 12:
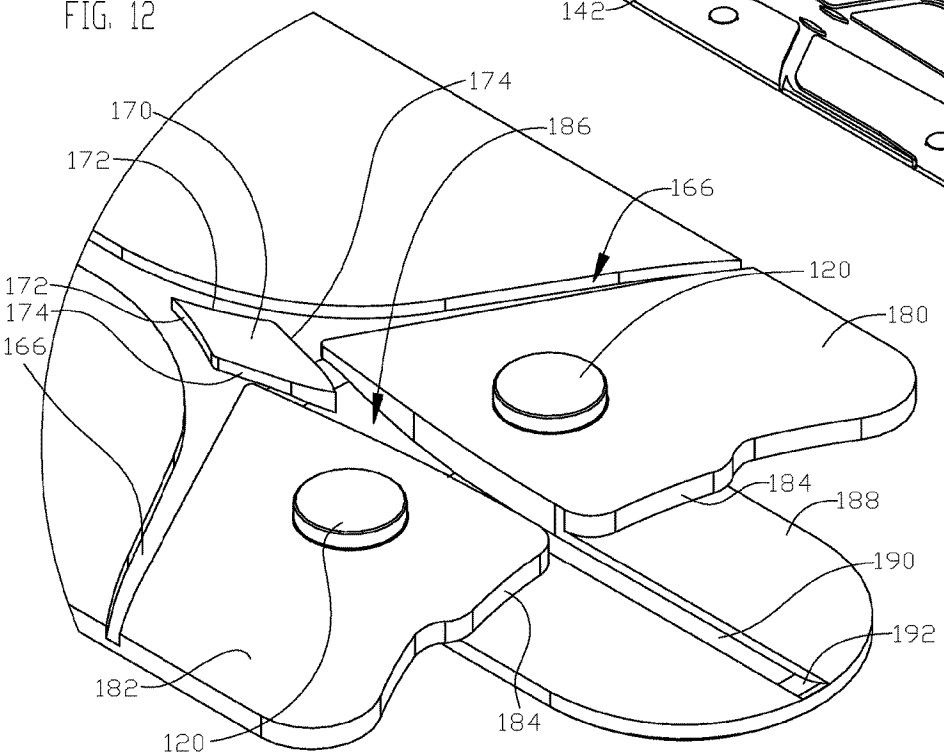
FIG. 12 is a detailed view of a portion of the core of FIG. 11.
Figure 13:
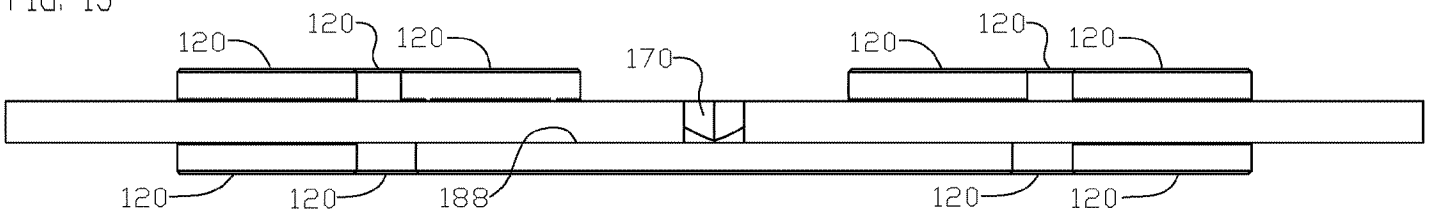
FIG. 13 is a right side view of the chain bar core of FIG. 5.

The outlet manifold 132 at the distal end portion of the core 106 includes planar panel portions 180 and 182 distal of the flow channels 166. The panel portions 180 and 182 extend substantially in the plane of the core. Bosses 120 extend upward from the respective panel portions (FIG. 12). The panel portions 180 and 182 extend distally to respective end surfaces 184 adjacent the nose sprocket.

The main flow channel leaves the diamond-shaped diversion element 170 and continues toward the nose sprocket and becomes deeper below the upper surface of the planar portions 180 and 182. The distal flow channel 186 (FIG. 12) has a depth that increases to be greater than the thickness of the planar portion of the core and into the outlet manifold 132, including that portion of the outlet manifold that extends into the plane of the second side plate 104 through the oval opening 128 (FIG. 4). The distal flow channel 186 permits fluid flow from the main flow channel underneath the nose sprocket to the bearings 124 and to the side of the nose sprocket 118. The outlet manifold includes a protruding plate 188 that extends into the oval opening. The distal flow channel 186 is formed in part in the protruding plate 188 while still being formed as part of the core 106. The distal flow channel 186 continues within the protruding plate 188 with a substantially flat bottom surface 192 and upwardly-curving surface 192 at the end of the flow channel. The upwardly-curving surface 192 forces the fluid to flow against the nose sprocket and the bearings. Other configurations of the core and/or outlet manifold can direct fluid in the area of the sprocket and bearings as desired.

The water flow channel surfaces are formed substantially smooth with a smooth finish. The remaining portions of the core 106, when formed from a plastic material, include a textured finish. The finish is a random texture that increases the surface area for bonding using adhesive or a bonding agent. The texture can be formed with a plastic part is molded, for example, or after. Molding can include a texture, such as through the technique applied by Mold-Tech. Other structures and methods may also be used for increasing bonding strength, such as cuts in the plastic or other core material described more fully herein.

The chain bar can be assembled from the first and second side plate and the core 106 by applying adhesive, for example to the second side plate over those surfaces where the core will be substantially opposite and in contact with the side plate but for the existence of the adhesive. The core is then placed against the second side plate using the bosses and the respective openings 122 for registration and alignment. The flow valve and nose sprocket assembly are placed in their respective positions relative to the core. The first side plate 102, with adhesive on that part of the surface that will come into contact with the core and bosses 120, is then placed against the core with the bosses 120 and registration with the openings 122. The nose sprocket and the fastening holes in the side plates are aligned as is conventional. The adhesive can then be cured to secure the laminate. It is noted that a plastic core 106 can be used to resist corrosion of the second side plate 104, and the adhesive on the first side plate 102 can also inhibit corrosion of the first side plate. Additionally, the adhesive can be cured with the first side plate down or on the bottom of the chain bar assembly during curing so that adhesive from the first side plate does not flow upward into the flow channels.

Figure 18:
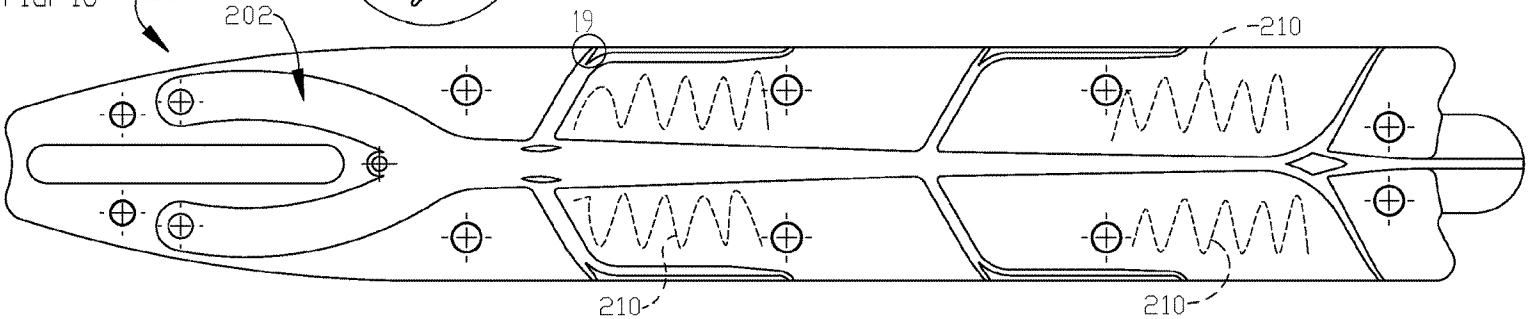
FIG. 18 is a top plan view of a chain bar core according to another example described herein.

In another example of a chain bar core that can be used with the side plates as described to form a chain bar assembly, a core 200 (FIG. 18) includes flow channels 202 that are formed completely through the entire thickness of the core. (The circles in FIG. 18 corresponding to the fluid inlet openings would not be present in the core, and the post for receiving the fluid valve 150 in the example of FIG. 4 would be supported on one of the adjacent side plate. Additionally, any islands or flow diversion elements that would be freestanding in a flow channel would be supported by one or both adjacent side plates.) The core can be formed from metal, plastic or other materials, for example by laser cutting or other forming technique.

Figure 19:
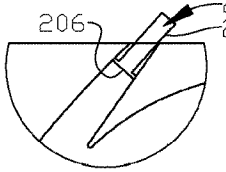
FIG. 19 is a detailed view of a portion of the core of FIG. 18.

In one example, the water channels are formed by cutting and connecting tabs such as tab 204 (FIG. 19) is maintained in the core to keep the various segments of the core coupled to each other and in the desired arrangement prior to assembly with the adjacent side plates. In the present example, the tab 204 includes a bridge portion 206 extending between adjacent spaced apart sidewalls of the corresponding flow channel and a manipulating portion 208. In the present example, the bridge portion 206 is internal to the perimeter of the core. In other examples, the bridge portion can be connected to the perimeter surface elements of the spaced apart segments forming a flow channel. The manipulating portion 208 can be used to remove the bridge portion 206 at the desired time, for example when the core 200 has been applied to an adjacent side plate, for example through adhesive. Each of the outlet ports can include respective tabs for maintaining the various otherwise separate core segments in their desired orientation with respect to each other. Additionally, tabs can be used to position islands or flow diversion elements as desired until such time as the core elements are positioned relative to a side plate. When a core assembly is ready to be applied to an adjacent side plate, for example through adhesive, the core and the side plate can be combined and the tabs removed. Thereafter, the opposite side plate can be applied to form the assembly and the adhesive cured. In this example, the depth of the flow channels extends the entire thickness of the core. In this example also, if desired, the portions of the outlet manifold 132 in the embodiment of FIGS. 4-17 outside the plane of the core can be omitted.

In any of the core examples described herein, flow channels and other core components can be formed by cutting, for example laser cutting. Additionally, the complementary openings 120 as well as other openings such as the channel 110 can be formed in the side plates by laser cutting or other cutting means. A core can also have laser cut or other formed openings through the core to assist in strengthening the resulting chain bar. For example, in the example of the core 200 shown in FIG. 18, serpentine laser cut lines 210 are formed in the core 200 forming passageways extending through the thickness of the core. The lines 210 are each a closed-circuit, and do not extend to an outer perimeter of the core. These lines are nonlinear longitudinally and transversely of the core. The lines in the present example are noncircular, and spaced apart sidewalls have substantially the same spacing. Additionally, the spacing between sidewalls is substantially the same from one end of the opening to the other. On assembly, for example with an adhesive to bond the layers together, adhesive enters the openings of the lines 200, and may even extend completely through the thickness of the core, and between the spaced apart sidewalls. Such adhesive pocketed cuts or lines improve the sheer strength of the chain bar.

In any of the core examples described herein, lighting components may also be included or otherwise adapted for illumination through the chain bar for illuminating the surrounding area. For example, LEDs can be mounted on the side plates, for example three per side, and set into respective openings in the side plates (not shown). In addition, or alternatively, light sources in the chainsaw motor housing can illuminate the chain bar, and a translucent side plate or side plates can transmit light from such light sources to the surrounding area. Translucent materials may include polycarbonate and Lexan. Current may be provided to LEDs or other light sources through conductors embedded in the core such as a plastic core, or in flow paths in the core. Current may be generated by a generator producing current arising from fluid flow past the generator. Alternatively, a battery or other energy source may be embedded in the chain bar, for example in the core or a side plate. Lighting can be turned on through a manually accessible switch, or a detent switch adjacent the chain that is activated through chain motion. Alternatively, power can be obtained from the chainsaw, such as through a spark plug or other electrical source.

The chain bar is an example of a structure that supports a moving tool such as an abrading or cutting chain, for example for cutting concrete. U.S. Pat. No. 5,078,119 is an example of an application for a chain cutting apparatus, the specification and drawings of which are incorporated herein by reference. While the present description of apparatus and methods for supporting working structures and methods of making such supporting structures describes chain bars, it should be understood that similar configurations and methods of forming the configurations can be applied to other structures and assemblies. However, the present description provides as examples chain bars for chainsaw cutting assemblies, for example for concrete and wood applications.

In another example of a support structure for supporting a moving structure such as a cutting chain, a chain bar 400 (FIGS. 20-22) can be assembled in one or more of the ways and having one or more of the structures described previously with respect to the chain bar 100 and FIGS. 1-19, but may adopt one or more of the features described with respect to FIGS. 20-26 and 28. Where features of the chain bar 100 are included in the chain bar 400, such features are designated with the same reference numeral. However, it should be understood that additional features may be included, or other features than those of FIGS. 1-19 may be used. In the present example, the chain bar includes first and second side plates 402 and 404, respectively, each of which includes a mounting and support slot 110 for engaging a complimentary support bar of a conventional chainsaw (not shown but represented schematically in the referenced patent). Each of the side plates 402 and 404 include respective tensioning openings 406 for properly tensioning the cutting chain as desired.

The first side plate includes a first fluid inlet opening 408 (FIGS. 20 and 21) for allowing cooling fluid from the coolant supply of the chainsaw to flow into passageways in the core, designated generally at 410 (FIG. 21) and described more fully below. The second side plate includes a second fluid inlet 412 (FIG. 21) for allowing coolant to flow into a respective passageway formed in the core 410. The first and second inlet openings 408 and 412 are positioned on opposite sides of the support slot 110 so that the chain bar can be reversible about a longitudinal axis (not shown) on the chainsaw and still allow coolant supply from a single coolant supply on the chainsaw.

The chain bar also includes a toothed transport element in the form of nose sprocket 118A having a plurality of evenly distributed openings to reduce the weight of the sprocket, and a plurality of teeth 1186 extending beyond an adjacent perimeter portion of the side plates for engaging the chain and guiding the chain around the chain bar. The sprocket is supported for rotational movement on a plurality of bearings 124 (FIG. 21) which are distributed about an apertured hub 126A. The hub and therefore the nose sprocket is secured between the first and second side plates through appropriate fasteners (not shown) conventional to chain bars.

Each of the first and second side plates include a plurality of matching holes, openings or apertures 414 for receiving registration or stack up pins (not shown) for assembling and securing the first and second side plates with the core elements during assembly. Each opening 414 in one side plate is exactly opposite a corresponding opening in the second side plate. Additionally, a pin extending between corresponding openings 414 in the side plates also pass through an adjacent structure or core element of the core assembly 410. During assembly, pins are placed in the openings 414 of one side plate and the core components of the assembly 410 are placed on their corresponding pins with adhesive 416 between the core component and the adjacent side plate. Adhesive is placed on the opposite core element surfaces and the other side plate placed against the core assembly 410 on the appropriate pins. The adhesive can then be cured to secure the side plates and the core assembly together. The nose sprocket assembly is secured in the conventional manner.

The side plates and the core assembly 410 include a proximal mounting area 418 (FIG. 20) for mounting the chain bar to a chainsaw. The geometry of the mounting area 418 is configured to correspond to the chainsaw with which it is to be used. The side plates in the mounting area include longitudinally extending and curving peripheral edge surfaces 420 and 422 (FIGS. 20-21) extending to a respective apex 424 and 426, respectively. The peripheral edge surfaces of the side plates support the cutting chain so that the cutting chain can extend longitudinally about the chain bar and pass over the outer peripheral edges of the chain bar. The peripheral edge surfaces of the chain bar are formed by respective peripheral edge surfaces of the corresponding side plates.

Considering first the first side plate 402, the side plate includes a longitudinally extending peripheral edge surface extending from apex 424, designated generally at 428. For purposes of the present description, both the upper and lower longitudinally extending peripheral edge surfaces of the first side plate will be designated 428 as they are mirror images of each other about a longitudinal axis, and the chain bar is reversible. It will be understood that the description of the peripheral edge surface 428 applies to both the upper and lower longitudinally extending peripheral edge surfaces. Additionally, the longitudinally extending, opposite peripheral edge surfaces of the second side plate 404 are also identical to each other.

The edge surface 428 of the first side plate 402 (FIGS. 20-24) includes a plurality of surface discontinuities designated generally at 430. The surface discontinuities can take a number of configurations, and one or more such a configurations may make the edge surface 428 non-straight or other than continuously straight. The discontinuities can be uniform or non-uniform, but the discontinuities illustrated in the drawings repeat and have uniform configurations between one another. The discontinuities can be formed by a plurality of grooves, channels, slots, depressions, dimples or other recessed areas formed into the peripheral, transversely facing edge surfaces of the side plate 402. The recessed areas can be uniform or nonuniform, but in the present examples are uniform in spacing between each other and are uniform transversely from one side of the first side plate to the opposite side of the first side plate. Between the recessed areas, raised areas extend forming raised formations, and may be ridges, plateaus, lands or other raised structures. The raised structures form raised formations that can be uniform or non-uniform between each other, but in the present examples are uniform in dimensions and are uniform transversely from one side of the first side plate to the opposite side of the first side plate. The raised formations provide support structures and they are spaced apart from each other by the recessed formations to support the cutting chain has the cutting chain moves longitudinally in a direction of chain movement, for example distally toward the nose of the chain bar and then returning from the nose to the drive sprocket (not shown). With the spaced apart raised formation areas, the cutting chain is supported by the peripheral edges of the first side plate but contact occurs only at the raised formations and little if any contact occurs between the chain and the recessed formations. This helps to reduce heat generation between the chain and the chain bar, and may also reduce wear. The raised formations can have flat top supporting surfaces, rounded supporting surfaces or other surface geometries in the direction of chain movement as well as transversely.

In the example shown in FIGS. 20-26, each raised formation forms a land 432 that is substantially identical to each other raised formation on the first side plate, and includes a relatively flat land surface 434 (FIGS. 23-24) extending transversely or widthwise of the side plate and longitudinally between adjacent grooves 436. Each land extends longitudinally a first distance 438 (FIG. 25) about 0.100 inch, and in the present examples 0.098 inch.

Figure 24:
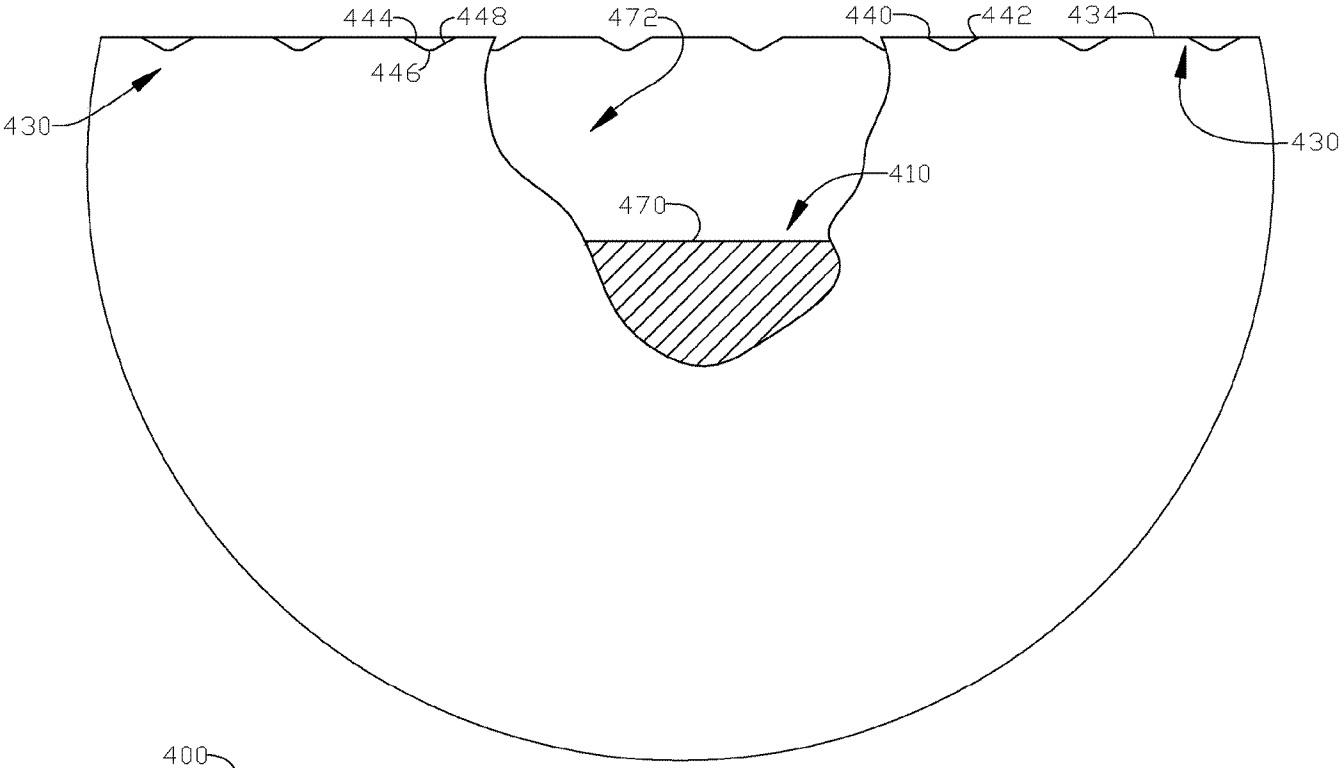
FIG. 24 is a side elevation and partial cutaway view of a portion of the chain bar of FIG. 20 taken long lines 24-24 in FIG. 22.

Each recessed formation is formed by the grooves 436, which in the present examples are substantially uniform between one another and spaced the same distance apart from each other. Each groove is substantially identical to each other and extends transversely or widthwise of the first side plate. Each groove extends longitudinally from a first, proximal radiused surface 440 (FIG. 23) to a second, distal radiused surface 442. The groove includes a first angled surface 444 extending downwardly and distally from the first surface 440 to a bottom radiused surface 446 (FIG. 24). The first angled surface in the present example extends at an approximately 60° angle to a vertical, or a line transverse to the longitudinal axis of the chain bar. A second angled surface 448 extends upwardly and distally to the second radiused surface 442. The second angled surface is also at approximately 60° to a vertical. The depth of the grooves can be selected as desired, and can range from approximately 0.010 inch or less to as much as approximately 0.100 inch or more. The groove depth in the present example is approximately 0.015 inch. The depth of the grooves can also range from approximately 5% of the length of the land surface to 100% or more. Additionally, the longitudinal length of a groove, or the spacing between adjacent land surfaces, may be between 40 and 60% of the length of the land surface, but can be more or less. In the present examples, their length is approximately half the length of the land surface. The length 450 of the angled surfaces (FIG. 25) can be approximately 0.0235, and the radius 452 of the bottom surfaces is 0.015, and the radius 454 of the proximal and distal surfaces 440 and 442 are 0.010.

Figures 20, 23:
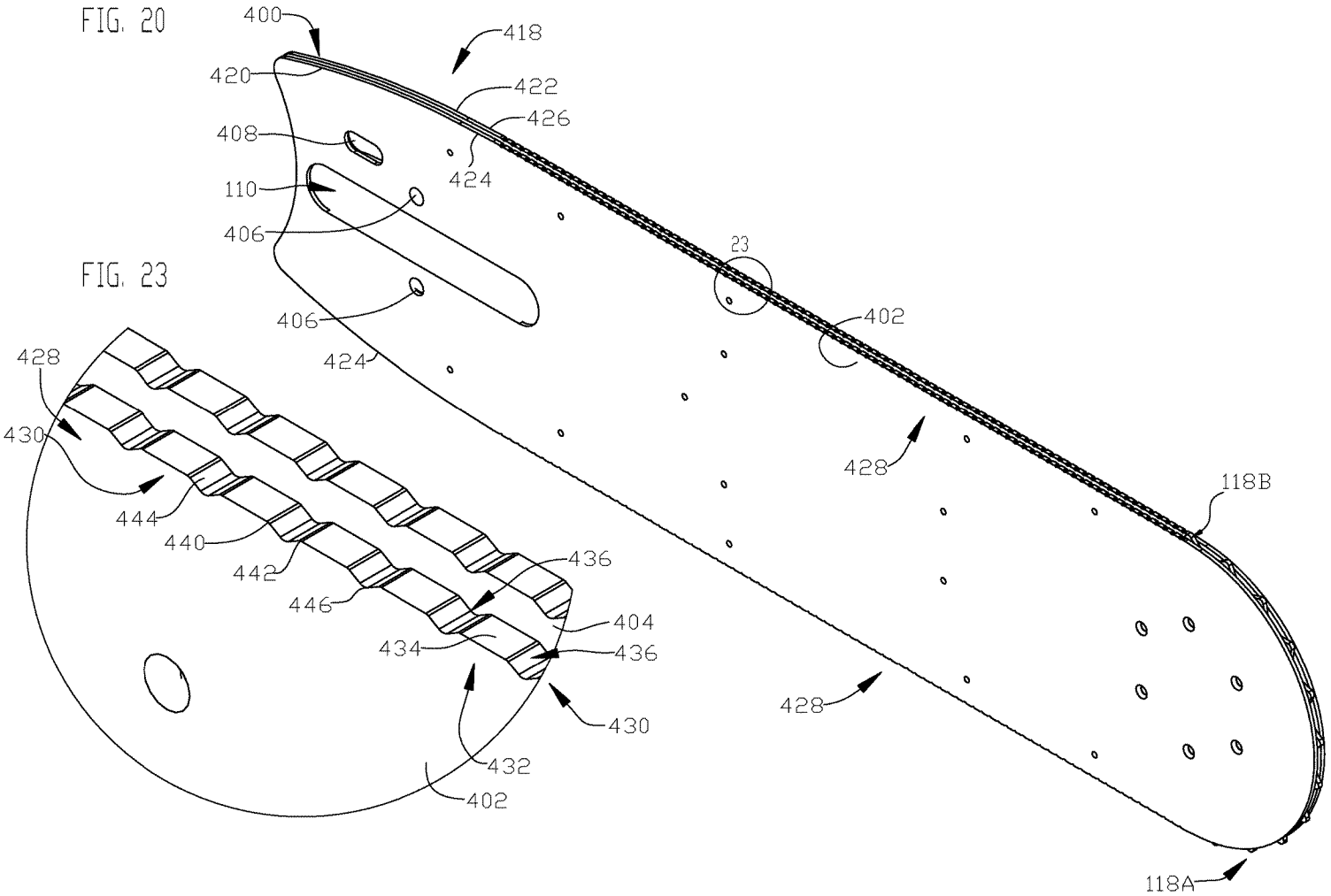
FIG. 20 is an upper isometric view of a chain bar as one example of a support structure for a moving element.
FIG. 23 is a detailed view of a portion of the chain bar of FIG. 20 taken at 23 and FIG. 20.
Figure 21:
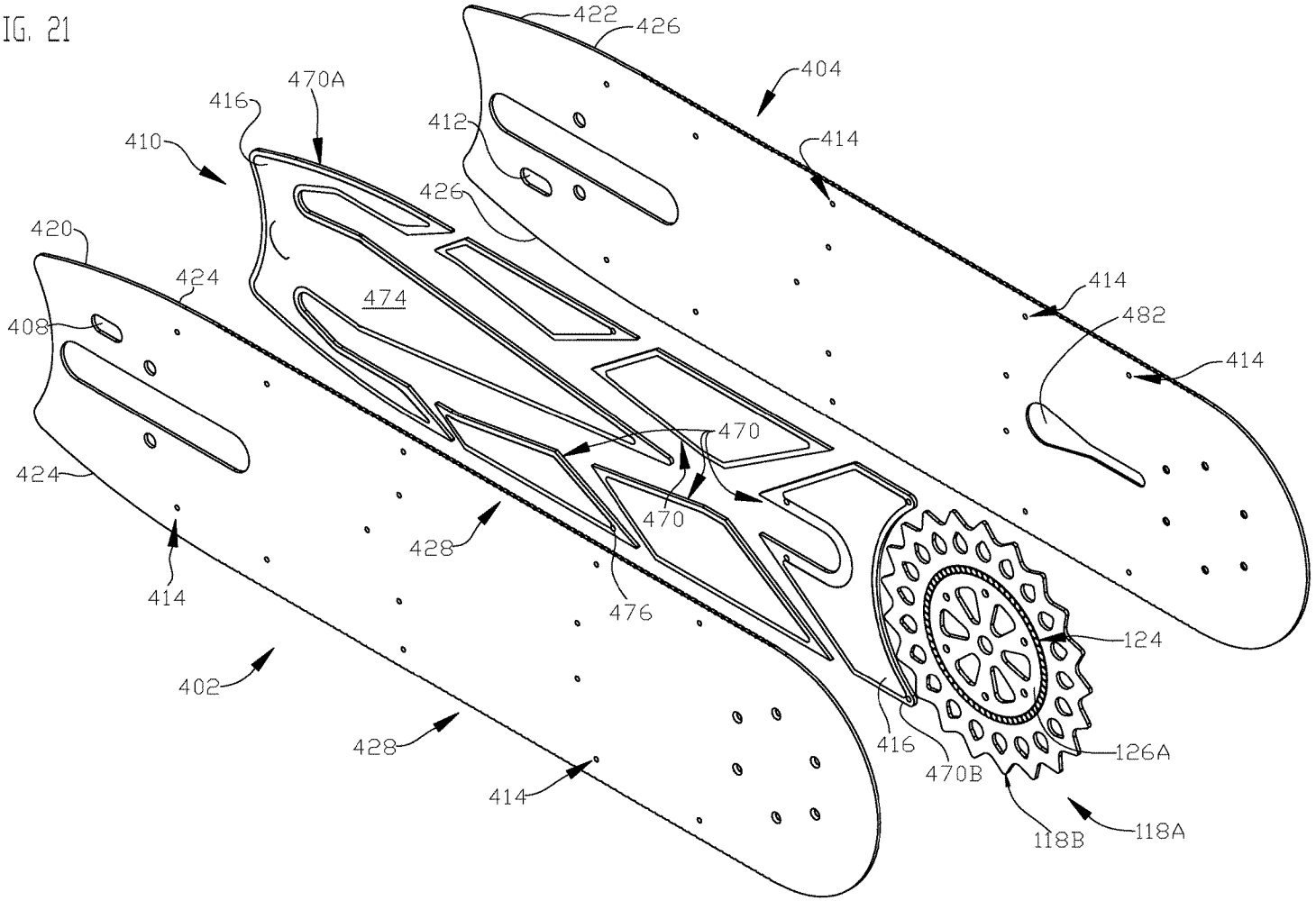
FIG. 21 is an exploded view of the chain bar of FIG. 20.
Figure 22:
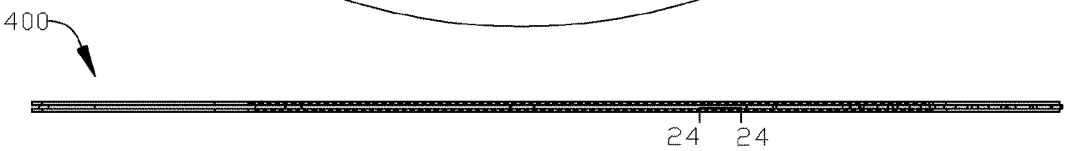
FIG. 22 is a side elevation of the chain bar of FIG. 20.
Figure 25:
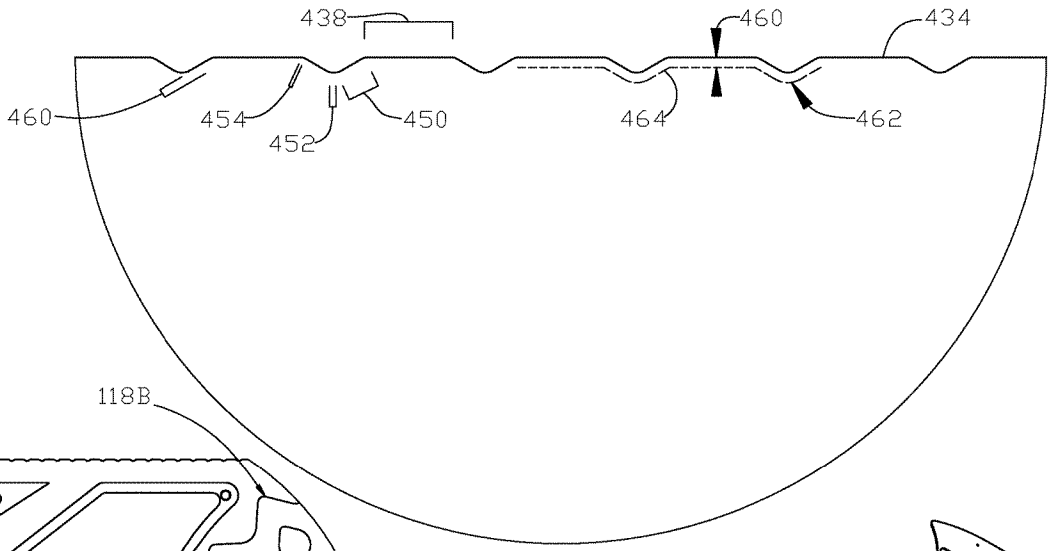
FIG. 25 is a side elevation view of a portion of a side plate of a chain bar such as that shown in FIG. 20.

In the example of the chain bar described with respect to FIGS. 20-26, both of the first and second side plates 402 and 404 include respective peripheral surface discontinuities. In the present example, both of the first and second side plates include identical sets of land formations 432 and groove formations 436 with adjacent ones in a given side plate identical to each other. The land formations and groove formations in the first side plate are identical to respective land formations and groove formations in the second side plate. However, the proximal to distal or longitudinal positioning of the land and groove formations on the second side plate 404 are shifted longitudinally relative to adjacent land and groove formations on the first side plate 402, as depicted in FIGS. 22-24. In the present example, they are shifted approximately halfway relative to each other, for example so that the bottom of a groove on one side plate extending transversely would intersect an approximate midpoint of a land formation on the second side plate. The relative positioning of the lands and grooves of one side plate to the other side plate can be different, but a 50% or 90° phase shift maximizes the support for a given point on the cutting chain as the cutting chain moves along the peripheral surfaces of the side plates. It also reduces the likelihood that any element of the chain would contact a groove surface below the radiused surfaces 440 and 442.

Figure 27:
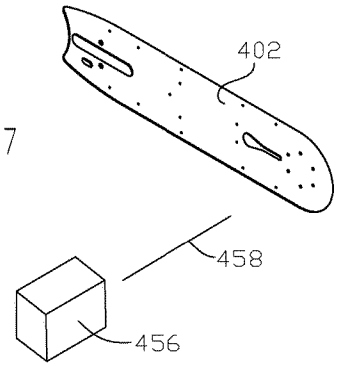
FIG. 27 is a schematic of a side plate and a laser cutting machine used to form a support structure such as one used in the chain bar of FIG. 20.

The groove formations and the land formations in each of the side plates can be formed by laser cutting, for example using a laser cutting apparatus such as that depicted schematically at 456 producing a laser cutting beam 458 for cutting the desired surface configurations on a chain bar plate such as the first side plate 402 (FIG. 27). For example, after the side plate 402 is cut or formed to produce a general chain bar profile and openings cut in the side plate, for example using the laser, such as for openings 110, 406, 408 and 414, the side plate can be heat-treated. Then the laser 456 is used to cut the recessed and raised formations to produce the final edge configuration 428, such as that depicted in FIGS. 20-26. In the present example, the laser 456 cuts continuously from a point distal of the Apex 424 (FIG. 21) to form the land surfaces and groove surfaces as described herein. Laser cutting continues along the longitudinal peripheral surface, and in the present example, to the beginning of the curvature forming the nose of the chain bar.

In conjunction with the laser cutting process, the resulting edge surface in a metal side plate such as those used in the chain bar is heat-treated to a known heat treat depth 460 (FIG. 25) of approximately 0.020 inch. This heat treat depth in the present example is continuous longitudinally under the peripheral edge surfaces formed by the laser cutting of the land formations and groove formations. Consequently, the maximum heat treat depth from the top of a land surface 434 to a point 462 transversely inward from the bottom of a groove is the heat treat depth available to support the movement of the chain over the side plate. Therefore, even if a land surface 434 wears down approximately 0.020 inch, each groove on each side of the land surface includes heat-treated material, such as at 464, which continues to support the chain. Additionally, the amount of support surface past or beyond the 0.020 heat treatment zone under the land surface 434 is approximately equal to the groove depth. Therefore, the groove depth effectively increases the depth of the heat-treated material as seen by the moving cutting chain. Because the heat treatment provided by laser cutting extends to a known depth, the relative dimensions of the land formations and the groove formations can be selected as desired to optimize the wear characteristics of the side plates and chain bar. Once the raised and recessed formations are formed on the respective side plates, the first and second side plates can be assembled with the core assembly through adhesive and the registration pins as described herein. The adhesive can then be cured to produce the final chain bar assembly.

In the present example, the core assembly 410 (FIGS. 21-24 and 26) includes a plurality of core elements 470 (FIG. 21) formed and configured to provide the desired flow channel configurations for the chain bar. The peripherally-outside surfaces of the core elements also define a channel 472 for receiving portions of the cutting chain between the side plates 402 and 404. In the present example, the proximal-most core element 470A includes a central body portion 474 extending approximately half the length of the chain bar to define the interior edge surfaces of longitudinally extending flow channels to feed the side flow channels defined by others of the core elements 470. Each of the core elements includes respective openings 476 for receiving the registration pins extending between the opposite side plates for fixing the side plates and the core elements. When the chain bar is ready to be assembled, adhesive 416 is applied to the surfaces facing the respective side plates and the chain bar assembled and the adhesive cured.

Figure 26:
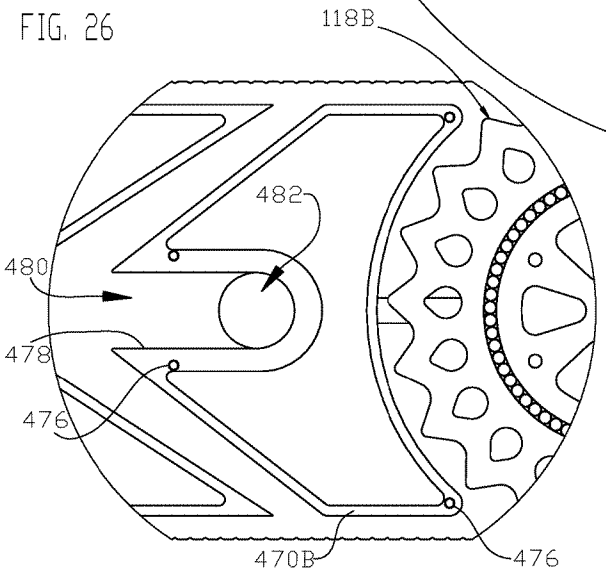
FIG. 26 is a detailed plan view of a nose portion of the chain bar of FIG. 20 with a side plate removed to show a coolant supply channel for a nose sprocket assembly.

A distal-most core element 470B (FIGS. 21 and 26) includes a proximal-facing, U-shaped cut 478 forming an inlet channel 480 for feeding fluid to the nose sprocket assembly. The inlet channel 480 extends to an opening 482 (FIGS. 21 and 26) formed into the second side plate 404. In the example shown, the opening 482 extends completely through the second side plate, but in another example can be formed to a depth into the second side plate less than the entire thickness of the side plate. In the example shown, the opening 482 is closed on the exposed side of the side plate by a cover, plug or other fluid seal to minimize the escape of fluid to the outside of the second side plate. Fluid flows parallel to the second side plate from the inlet 480 to an area underneath the nose sprocket assembly (as shown in FIG. 26). Other configurations for supplying fluid to the area of the nose sprocket assembly can be used.

Figure 28:
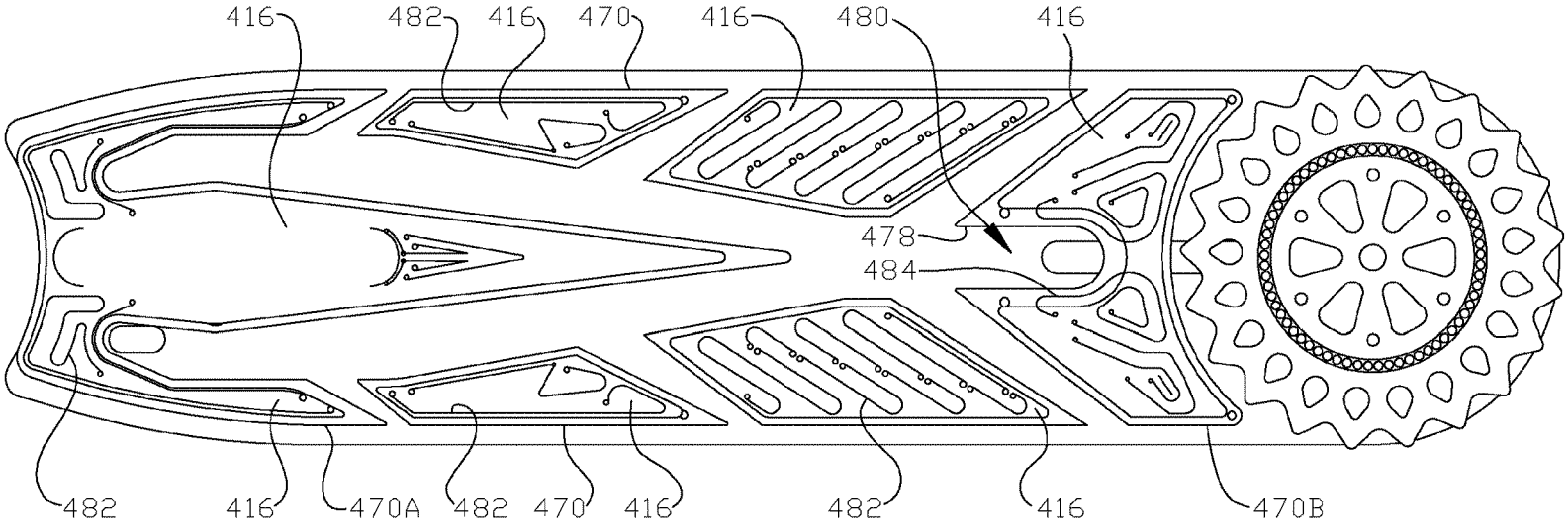
FIG. 28 is a plan view of medial or core components showing various openings through the components for adhesive flow and sealing between the components and adjacent chain bar side plates.

In a manner similar to that described previously with respect to FIG. 18, each of the core elements 470 can include a plurality of openings, apertures or laser cuts 482 extending through the entire thickness of each core component to allow adhesive to extend through each core component and between the opposite side plates (FIG. 28). A plurality of the cuts 482 extends along or substantially parallel to flow channel edge surfaces of the core element. The cuts 482 can be continuous or broken, many of the cuts shown in FIG. 28 being broken or discontinuous. Laser cuts 44 adjacent to channel 480 in the distal-most core element are cut at locations between the wall 478 and the interior edge of the applied adhesive layer 416, to minimize adhesive flow into the inlet 480.

When a cutting chain is mounted on the chain bar with the chain bar installed on a chainsaw, the chain bar supports the cutting chain but the cutting chain links make only intermittent contact with the peripheral edge surfaces of each side plate. During operation, wear of the peripheral edge surfaces can be reduced because of the intermittent contact between the chain and the side plate surfaces. The cutting chain moves continuously at a relatively high speed over the chain bar surfaces but the generation of heat through friction can be reduced by the intermittent contact between the chain and the side plate edge surfaces. While the chain cuts the concrete, moving around the chain bar, the exposed surfaces of the land formations gradually wear exposing outer or shallow portions of the groove surfaces, while leaving deeper portions of the grooves relatively untouched. Therefore, as wear continues, heat-treated surfaces still remain for supporting the chain further into the groove and below, to the extent of the known heat treat depth. Additionally, the staggered or shifted land formations between the first and second side plates help to fully support the chain on the chain bar. The cutting chain can be in contact with a raised land formation on the first side plate while passing over a recessed groove area on the second support plate.

Having thus described several exemplary implementations, it will be apparent that various alterations and modifications can be made without departing from the concepts discussed herein. Such alterations and modifications, though not expressly described above, are nonetheless intended and implied to be within the spirit and scope of the inventions. Accordingly, the foregoing description is intended to be illustrative only.

What is claimed is:

1. A conveyor bar for supporting and guiding a conveyor along a path defined at least in part by the conveyor bar, the conveyor bar comprising a support surface extending at least partly in a direction of the path, the conveyor bar including a thickness defining a width of the conveyor bar, wherein the conveyor bar includes a toothed transport element in the path and wherein the toothed transport element and the support surface are both within the thickness of the conveyor bar and wherein the toothed transport element has at least one tooth extending in the path and outward of the conveyor bar, and wherein the support surface includes a peripheral edge surface having a plurality of raised portions extending along the peripheral edge surface and outward of the conveyor bar, wherein adjacent ones of the plurality of raised portions are spaced apart from each other by a respective recessed portion, wherein the at least one tooth extends outward of the conveyor bar a distance greater than the plurality of raised portions extend outward of the conveyor bar, and at least one adjacent raised portion in the plurality of raised portions extends along the path a first distance and the respective recessed portion extends a second distance less than the first distance.

2. The conveyor bar of claim 1 wherein at least two raised portions in the plurality of raised portions include flat surfaces facing away from the conveyor bar.

3. The conveyor bar of claim 1 wherein at least two raised portions in the plurality of raised portions have flat surfaces extending widthwise.

4. The conveyor bar of claim 1 wherein first and second adjacent raised portions in the plurality of raised portions extend in the path respective first and second distances, and wherein the first and second distances are substantially equal.

5. The conveyor bar of claim 4 wherein at least one of the recessed portions includes an angled side extending from an outer surface of a raised portion to a base surface of the recessed portion.

6. The conveyor bar of claim 5 wherein the base surface of the at least one recessed portion is curved.

7. The conveyor bar of claim 5 wherein a transition from an outer surface of the first raised portion in the plurality of raised portions to an angled side of the at least one recessed portion is curved.

8. The conveyor bar of claim 1 wherein at least one raised portion in the plurality of raised portions extends along the path a first distance from a start of the at least one raised portion to an end of the at least one raised portion, wherein a second distance extends from the start of the raised portion to a start of an adjacent raised portion, and wherein the first distance is approximately two-thirds the second distance.

9. The conveyor bar of claim 1 wherein the conveyor bar is metal and wherein the plurality of raised portions are heat-treated.

10. The conveyor bar of claim 9 where the plurality of raised portions are heat-treated to a discrete depth from a surface of at least one of the respective raised portions.

11. The conveyor bar of claim 1 wherein the plurality of raised portions are formed by laser cutting.

12. The conveyor bar of claim 1 wherein the conveyor bar includes a first support plate and the plurality of raised portions is a first plurality of raised portions on the first support plate and further including a second support plate spaced apart from the first support plate, and wherein the second support plate includes a support surface extending at least partly in a direction parallel to the path and wherein the second support plate support surface includes a second plurality of raised portions.

13. The conveyor bar of claim 12 wherein the second plurality of raised portions are spaced apart from the first plurality of raised portions and shifted along the path relative to the first plurality of raised portions a distance less than a length of a raised portion.

14. The conveyor bar of claim 12 further including a core element between the first and second support plates and having a core surface adjacent and recessed on a side of the respective recessed portion opposite adjacent raised portions in the plurality of raised portions on the first support plate.

15. A chain bar support element for supporting a chain having a plurality of cutting or abrading or other working elements, the chain bar support element including a toothed transport element and a support surface extending widthwise and at least partly in a first direction, the support surface including a peripheral edge surface having a plurality of raised portions wherein adjacent ones of the plurality of raised portions are separated by corresponding recessed portions, and each raised portion in the adjacent ones of the plurality of raised portions includes a support surface facing outward of the chain bar support element for supporting a chain, wherein the toothed transport element extends outward of the chain bar support element a distance greater than the plurality of raised portions extend outward of the chain bar support element, and at least one adjacent raised portion in the plurality of raised portions extends a first distance in the direction of the path and the corresponding recessed portion extends a second distance in the direction of the path less than the first distance.

16. The chain bar support element of claim 15 wherein the chain bar support element is metal.

17. The chain bar support element of claim 15 wherein the plurality of raised portions are laser cut.

18. The chain bar support element of claim 15 wherein the support surface facing away from the chain bar support element is substantially flat.

19. The chain bar support element of claim 15 wherein at least one of the recessed portions forms an angled groove.

20. The chain bar support element of claim 15 wherein the plurality of raised portions and the corresponding recessed portions include heat-treated portions wherein the heated treated portions extend to a discrete depth.

21. The chain bar support element of claim 15 wherein the plurality of raised portions is a first plurality of raised portions and further including a core element fixed to the chain bar support element with a core element surface extending along a path in the first direction adjacent and below the first plurality of raised portions and the recessed portions and wherein the chain bar support element includes a first support plate and further including a second support plate fixed to the core element on a side of the core element opposite the first support plate, and wherein the second support plate includes a second plurality of raised portions and recessed portions spaced apart from the first plurality of raised portions and the corresponding recessed portions on the first chain bar support element.

22. The chain bar support element of claim 21 wherein the second plurality of raised portions are shifted in the first direction relative to the first plurality of raised portions.

23. The chain bar support element of claim 21 wherein a second raised portion in the second plurality of raised portions on the second support plate is substantially opposite respective raised portions in the first plurality of raised portions in the first support plate.

24. The chain bar support element of claim 15 where the chain bar support element is heat-treated to a depth normal to a surface of the chain bar support element approximately 0.020 inch.

25. The chain bar support element of claim 15 wherein the chain bar support element is substantially planar, extends substantially longitudinally from a proximal end to be mounted on a drive component to a distal end, and wherein raised and recessed portions extend along one side of the chain bar support element and along a second side of the chain bar support element between the proximal end and the distal end.

26. The chain bar support element of claim 25 wherein the chain bar support element lacks any raised or recessed portions at the distal end.

27. The chain bar support element of claim 15 wherein the chain bar support element includes adhesive over a surface of the chain bar support element.

28. A method of forming a conveyor bar comprising positioning a conveyor bar element, identifying a side of the conveyor bar element extending in a first direction to be followed by a conveyor and having a thickness in defining a width wherein the conveyor bar side extending in the first direction and having the width forms a supporting surface for a conveyor, and including in the conveyor bar element the supporting surface configured with a plurality of raised portions wherein adjacent raised portions are separated from each other by a corresponding recessed portion, and wherein at least one adjacent raised portion in the plurality of raised portions extends a first distance in the direction of the conveyor path and the corresponding recessed portion extends a second distance in the direction of the conveyor path less than the first distance.

29. The method of claim 28 wherein identifying includes identifying a side of the conveyor bar wherein the supporting surface is heat-treated.

30. The method of claim 28 further including selecting a conveyor bar wherein the raised portions are formed by laser cutting.

31. The method of claim 28 further including selecting a conveyor bar wherein the supporting surface is heat-treated to a depth of approximately 0.020 inch normal to the supporting surface.

32. The method of claim 28 wherein the conveyor bar element includes a first support plate, further including fixing the first support plate to a core and fixing a second support plate to a side of the core opposite the first support plate.

33. The method of claim 32 wherein the plurality of raised portions is a first plurality of raised portions and the second support plate includes a second plurality of raised portions and wherein fixing the second support plate to the core includes positioning the second support plate so that the second plurality of raised portions is other than exactly opposite the raised portions on the first support plate.

34. The method of claim 33 wherein the raised portions on the second support plate are substantially opposite the recessed portions on the first support plate.

* * * * *